US007567041B2

(12) United States Patent
Okamoto

(10) Patent No.: US 7,567,041 B2
(45) Date of Patent: Jul. 28, 2009

(54) DISCHARGE LAMP LIGHTING APPARATUS AND PROJECTOR

(75) Inventor: Masashi Okamoto, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 186 days.

(21) Appl. No.: 11/704,984

(22) Filed: Feb. 12, 2007

(65) Prior Publication Data

US 2007/0188113 A1 Aug. 16, 2007

(30) Foreign Application Priority Data

Feb. 10, 2006 (JP) ..... 2006-033515

(51) Int. Cl.
*G05F 1/00* (2006.01)

(52) U.S. Cl. ..... 315/292; 315/274; 315/247; 315/308; 315/291

(58) Field of Classification Search ..... 315/149–159, 315/224, 291, 292, 307, 209 R, 247, 246, 315/274

See application file for complete search history.

(56) References Cited

FOREIGN PATENT DOCUMENTS

| | | | |
|---|---|---|---|
| EP | 1594156 | A2 | 11/2005 |
| JP | 2005-267933 | A | 9/2006 |
| WO | WO-95/11572 | A1 | 4/1995 |
| WO | WO-02/063391 | A1 | 8/2002 |

*Primary Examiner*—Tuyet Vo
(74) *Attorney, Agent, or Firm*—Rader, Fishman & Grauer, PLLC

(57) ABSTRACT

In a lamp lighting apparatus for lighting a high intensity discharge lamp, which is used for a projector, it is possible to carry out high speed modulation of brightness of the discharge lamp, in synchronization with a conversion operation to sequential color light flux which is carried out by using a dynamic filter such as a rotation color wheel, and it is also possible to switch modulation patterns by electric control. A lamp current detection signal conversion circuit has two or more switching elements whose ON/OFF state is controlled corresponding to truth/false of respective bits of modulation signal, in which a gain can be changed by a combination of truth and false of the respective bits of the modulation signal. When a modulation switching timing signal is received, an original modulation signal is updated by selecting a bit set corresponding to a value counted by a modulation change count section.

13 Claims, 9 Drawing Sheets

FIG. 3A
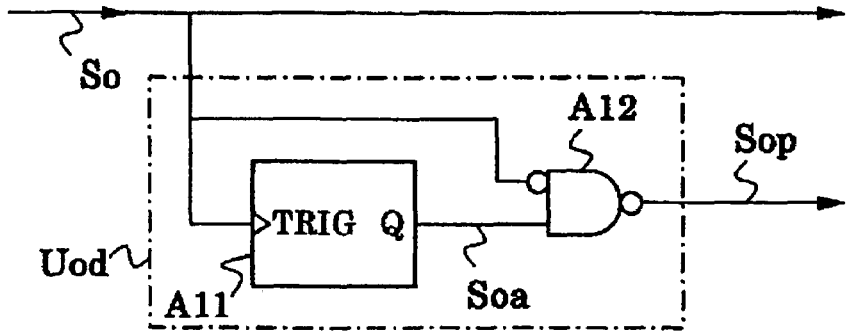
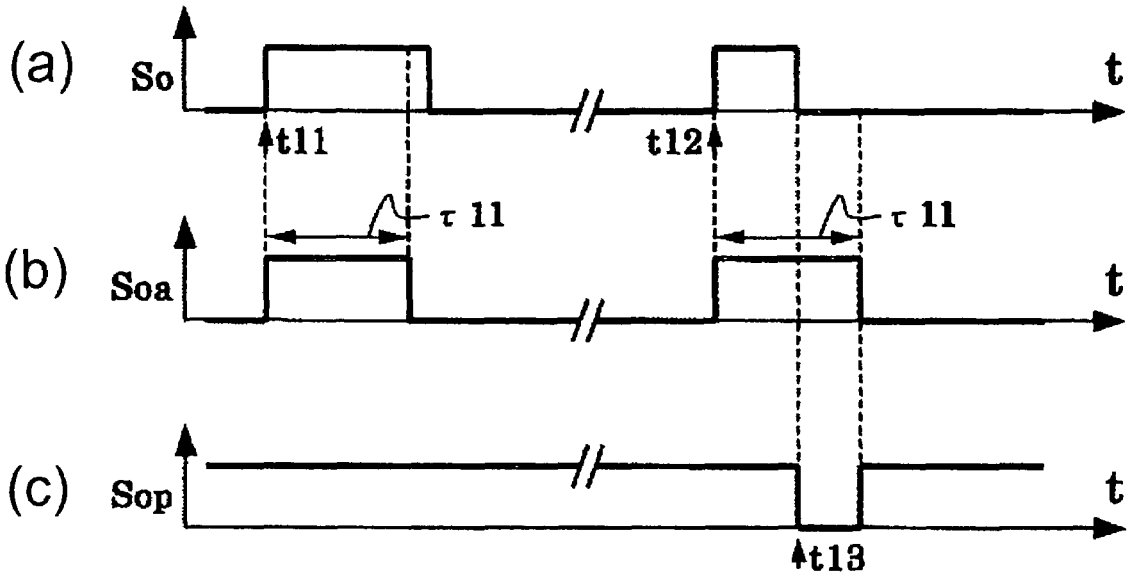
FIG. 3B

FIG. 8
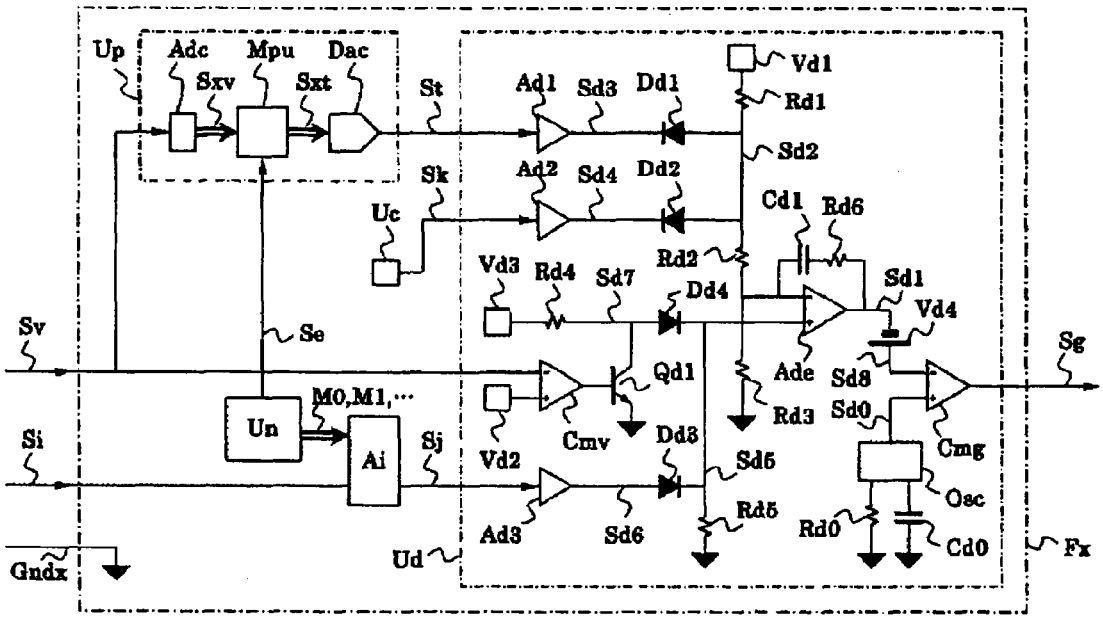
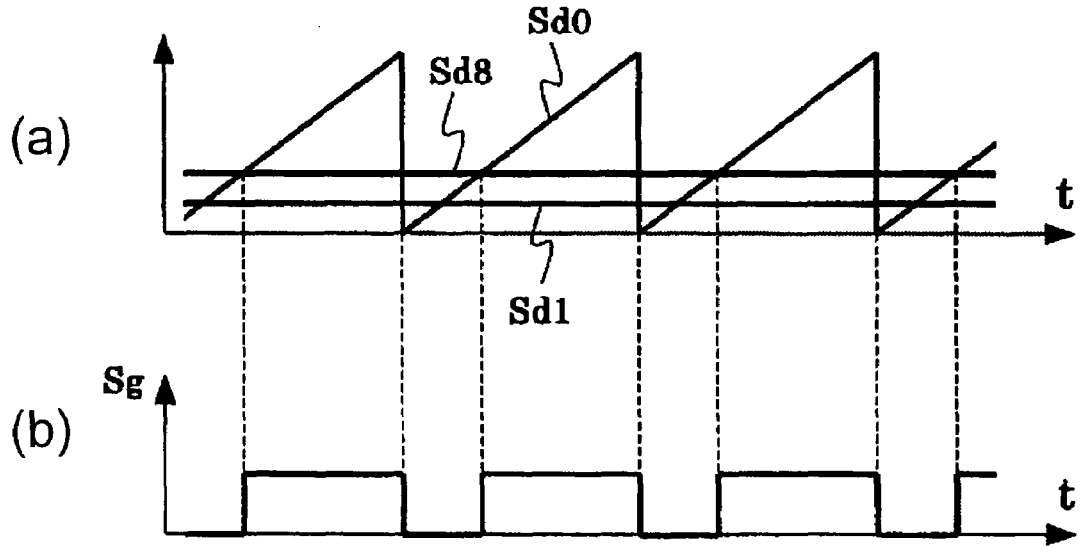
FIG. 9

FIG. 14
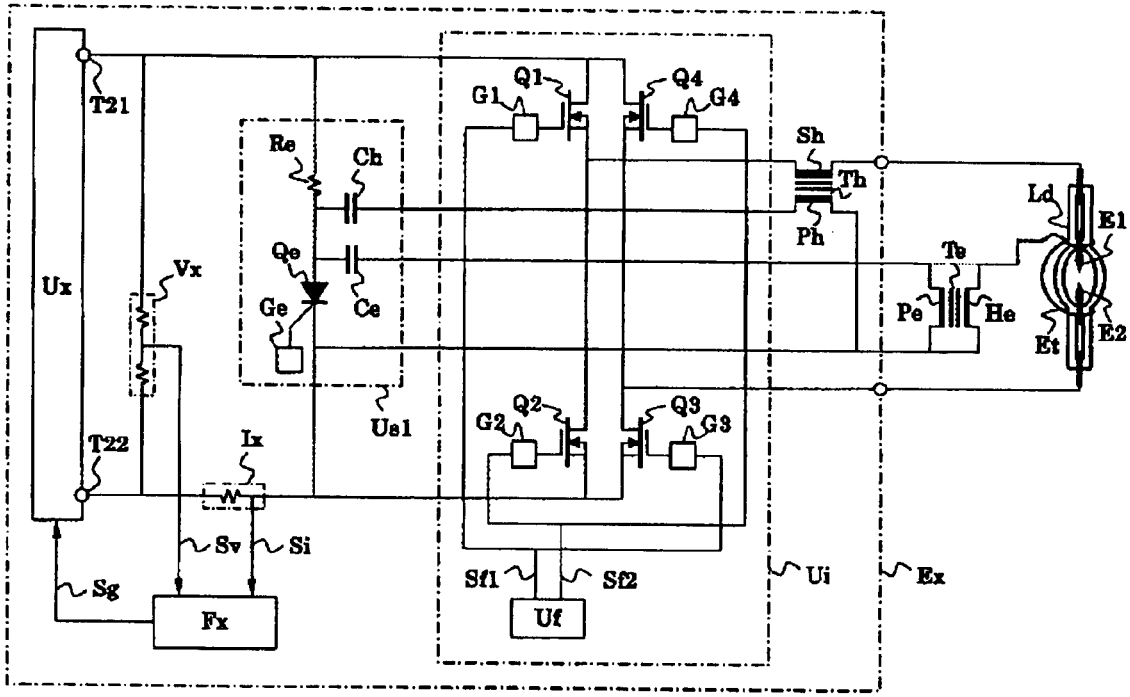
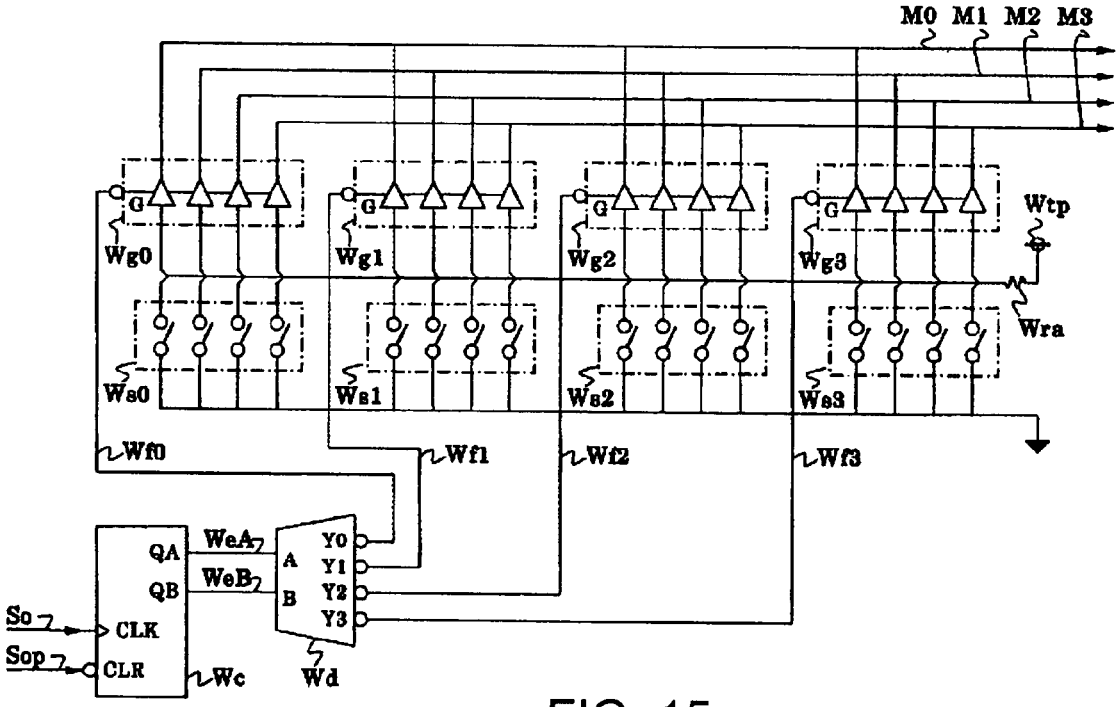
FIG. 15

DISCHARGE LAMP LIGHTING APPARATUS AND PROJECTOR

RELATED APPLICATION

The disclosure of Japanese Patent Application No. 2006-33515, filed Feb. 10, 2006, including the specification, claims and drawings, is incorporated herein by reference in its entirety.

FIELD

Described herein are a discharge lamp lighting apparatus for lighting a high voltage discharge lamp (especially high voltage mercury lamp) or a high intensity discharge lamp such as metal halide lamp, xenon lamp, and a projector in which the discharge lamp lighting apparatus is used.

BACKGROUND

For example, a high intensity discharge (HID) lamp is used in a projector of an optical apparatus for displaying an image, such as a liquid crystal projector or a DLP (trademark) projector. In such a projector, light is split into three primary color components of red (R), green (G), and blue (B) by using a dichroic prism or the like, and images of respective three primary colors are generated by using spatial modulation elements provided for the respective three primary colors. The paths of the generated three primary color images are combined by using a dichroic prism or the like, so as to display a full color image on a screen or display.

In another known type of projector, light emitted from a light source is passed through a rotating dynamic color filter having transmission color wheel having a three primary color (R, G, and B) filter, thereby sequentially generating light rays of the three primary colors. In synchronization with the generation of the light rays, a spatial modulation device is controlled so as to sequentially generate images of respective three primary colors thereby displaying a color image.

In such a discharge lamp lighting apparatus in which a discharge lamp is lighted, a dielectric breakdown is caused in a discharge space at initiation of lighting, by applying high voltage to the discharge lamp, while non-load open voltage is impressed thereto. The state of the discharge caused by the application of the high voltage changes from glow discharge to arc discharge, so that stable lighting is realized. The lamp discharge voltage which was low, for example, about 10 V after the transition to the arc discharge, rises, as the temperature of the lamp rises. And, at a steady state of lighting, the lamp voltage is stabilized at fixed voltage.

Usually, such a discharge lamp lighting apparatus has a converter which adjusts an output of an input power supply device so as to be suitable for the lamp discharge voltage so that lamp current required in order to realize predetermined power to be applied to the lamp can be outputted.

Moreover, the lamp voltage, i.e., the output voltage of the converter, is detected, and based on this information, the target electric current is determined by a value obtained by truncating a value obtained by dividing the target electric power by the detected voltage.

As discharge lamp driving methods, there are a direct-current drive method in which the lamp is turned on by a converter, and an alternating current driving method in which periodic polarity inversions are carried out by further providing an inverter in the output side of the converter.

In the case of the direct-current drive system, since the flux of light from a lamp does not change like the alternating current method (time-wise), either, it is advantageous that the method can be similarly applied to the both types of projectors which are described above.

On the other hand, in the case of the alternating current driving method, while growth or wear of the electrode(s) of the discharge lamp can be controlled by using the flexibility of polarity-inversion frequency which does not exist in the direct-current driving method, there is also a disadvantage resulting from the polarity inversions, such as an instantaneous light-out at the time of polarity inversions, or overshoot, etc. thereby affecting a display image adversely.

In order to obtain high color-reproduction performance of a display image, spectrum distribution of a light source lamp and adjustment of the conversion form of the sequential color light flux produced by using the dynamic color filter are important. In the case of the color wheel, color-reproduction performance or desired color-reproduction performance can be improved by setting up angle distribution of the respective color areas R, G, B (and W (white) if necessary), i.e., the rate of the time in which each color per rotation is transmitted, according to the spectrum of the lamp.

For example, when the lamp in which the R component is not sufficient is used, the R component transmission area is enlarged. That is, it is effective to make the rate of the time in which the R component is transmitted, longer than those of the other colors. However, in order to obtain a desired color-reproduction performance by such a method, for example, in a DLP type projector, the brightness for every color of each pixel of a display image is controlled by the duty cycle ratio of operation for each pixel of a space modulation element. Therefore, in the color component whose transmission time rate is reduced, there is a problem that fine control of the tone of a pixel cannot be easily carried out.

In order to solve the problem, in Japanese Laid Open Patent No. 08-505031, an image projection apparatus having a light source drive control unit in which output power of the light source is changed synchronizing with a color of the optical beam given by an output of a color change unit, is proposed. However, the concrete structure of such a light source drive control unit is not shown in the reference.

Similarly, in Japanese Laid Open Patent No. 2004-526992, a color-display apparatus in which electric power corresponding to colors is supplied, is proposed. In this reference, an electric wiring block diagram of an arc discharge lamp stabilization circuit capable of changing the electric power supplied to the lamp at high speed is disclosed. However, the circuit can set up only two power supply levels. Thus, the circuit cannot set up the electric power supplied to the lamp according to three colors R, G, and B or four colors R, G, B and W.

Moreover, in such a circuit, when the balance of the power level to be set up is changed, it is necessary to replace resistors of the circuit with those having different resistance.

Thus, in order to solve the problem, it has been known that high-speed modulation of the brightness of light from the light source which is synchronized with a conversion operation of the sequential color light flux carried out by dynamic color filter is useful, but high speed modulation of the brightness having arbitrary property at a low cost has not been realized.

On the other hand, Japanese Laid Open Patent No. 2005-267933 discloses that a lamp current detection signal conversion circuit is provided, wherein the gain thereof can be changed by switching corresponding to two or more bits modulation signal (M0, M1, . . . ). According to this structure of the discharge lamp lighting apparatus, the brightness of light from the discharge lamp light source is modulated (adjusted) with an arbitrary waveform at high speed. If this technology is simply used so as to realize the high-speed modulation of the brightness of light from the light source which is synchronized with a conversion operation of the sequential color light flux which is carried out by using a dynamic color filter, a circuit arrangement of a modulation signal generation circuit (Un) which generates the modulation signals (M0, M1, . . . ) can be shown in FIG. 15.

A signal which is generated based on an operation of a dynamic color filter (Of) in order to control timing of modulation condition change, and which is inputted from the outside of the discharge lamp lighting apparatus, for example, in case that in a color wheel type, a modulation switching timing signal (So) which is generated like a pulse at every color transition accompanied by rotation, is inputted in a clock pulse input terminal of a counter (Wc) which is formed by using a general-purpose IC, such as SN74HC161. A signal which is generated based on an operation of the dynamic color filter (Of) in order to identify the phase in a sequential color cycle, and which is inputted from the outside of the discharge lamp lighting apparatus, for example, in case that in a color wheel type, a modulation cycle initialization signal (Sop) which is generated like a pulse once per rotation and which is superposed on a particular modulation switching timing signal (So) is inputted in a clear input terminal of the counter (Wc). According to the structure, color information of the dynamic color filter (Of) which appears at that time can be identified by using a color code signal (WeA, WeB) which is a 2-bit count value output of the counter (Wc). Here, it is an assumption that the dynamic color filter (Of) has four colors areas (R, G, B, and W).

The color code signals (WeA, WeB) are inputted into a decoder (Wd) which is formed by using a general-purpose IC, such as SN74HC139, and only one corresponding to the color appearing at the time, of the four color information selection signals (Wf0, Wf1, Wf2, Wf3) which are outputs thereof is activated. The color information selection signals (Wf0, Wf1, Wf2, Wf3) are inputted into control input terminals of tri-state gates (Wg0, Wg1, Wg2, Wg3) which are respectively provided corresponding to these signals, wherein, for example, the tri-state gates are formed by using a general-purpose IC, such as SN74HC244.

The switch arrays (Ws0, Ws1, Ws2, Ws3), each of which comprises four switches, for setting up connection/disconnection to the ground are connected to input data terminals of the tri-state gates (Wg0, Wg1, Wg2, Wg3), respectively, and are pulled up with a resistor array (Wra) which comprises sixteen resistors to a power supply terminal (Wtp). In addition, the reason that the switch arrays (Ws0, Ws1, Ws2, and Ws3) comprise the four switches respectively, is that, the modulation signals (M0, M1, M2, M3) comprises 4-bits. Thus, it is possible to increase or reduce the number of the switches, if necessary, according to resolution required for modulation. According to the structure, since only one of input data corresponding to the color information which appears at that time, among the tri-state gates (Wg0, Wg1, Wg2, Wg3) is outputted to an output-data terminal, and the other output-data terminals for the other input data are maintained at a high impedance, it is possible to generate the modulation signals (M0, M1, M2, M3) by sending the output data of the bits to which the tri-state gates (Wg0, Wg1, Wg2, Wg3) correspond, respectively.

Namely, in the modulation signal generation circuit (Un) shown in FIG. 15, according to the modulation switching timing signal (So) and the modulation cycle initialization signal (Sop) which are generated based on an operation of the dynamic color filter (Of), a setting of the switch connection/disconnection state of one of the switch arrays (Ws0, Ws1, Ws2, Ws3) which corresponds to the color information appearing in the dynamic color filter (Of) at the time, is selected, so that the modulation signals (M0, M1, M2, M3) as digital value can be generated. Specifically, when the modulation switching timing signal (So) is received, the modulation signals (M0, M1, M2, M3) are generated according to a setting of the switch array (Ws1). After that, when the modulation switching timing signal (So) is received, the modulation signals (M0, M1, M2, M3) are generated according to a setting of the switch array (Ws1). After that, when the modulation switching timing signal (So) is received, the modulation signals (M0, M1, M2, M3) are generated according to a setting of the switch array (Ws2). Further, after that, when the modulation switching timing signal (So) is received, the modulation signals (M0, M1, M2, M3) are generated according to a setting of the switch array (Ws3), respectively. After that, this operation is repeated. And theoretically it is possible to realize a discharge lamp lighting apparatus capable of the high-speed modulation of the brightness of the light source which is synchronized with a conversion operation of the sequential color flux of light using a dynamic color filter which is carried out by using the above-mentioned modulation signal generation circuit (Un) as a modulation signal generation circuit (Un) in the technology disclosed in Japanese Laid Open Patent 2005-267933.

However, the modulation signal generation circuit (Un) shown in FIG. 15 has disadvantages. First of all, the number of circuit elements is large, so that the cost thereof tends to be high. In addition, since the circuit substrate occupies a large space, it is disadvantageous in terms of miniaturization of the discharge lamp lighting apparatus.

Secondly, since the modulation signals (M0, M1, M2, M3) according to the settings of the switch arrays (Ws0, Ws1, Ws2, Ws3) is repeatedly generated as described above, when change of the modulation pattern is required, it is necessary to change the connection/disconnection pattern of the switch arrays (Ws0, Ws1, Ws2, Ws3). That is, it is practically impossible to change the modulation pattern after the projector is shipped from the factory.

When making the patterns of a modulation waveform, i.e., modulation, changeable by an operation of a user, it is possible to mount two or more sets of switch arrays (Ws0, Ws1, Ws2, Ws3) each of which comprising four switches, and to choose one of them. Although it is necessary to eliminate the switch arrays (Ws0, Ws1, Ws2, Ws3), and, for example, instead of that, it is necessary to supply sixteen input signals of the tri-state gate (Wg0, Wg1, Wg2, Wg3) from output ports of a microprocessor etc.

In any case, there is a problem that a circuit becomes large-scale. Especially in the case of the latter, it is very difficult to assign the sixteen output ports to the microprocessor.

In order to avoid this, instead of the switch arrays (Ws0, Ws1, Ws2, Ws3), for example, a shift register with a parallel output, formed by using a general-purpose IC, such as SN74HC164, is mounted, so as to solve the assignment problem of the output ports of the microprocessor by configuring it so that one of the output ports of the microprocessor may be assigned to a data bit and one of them may be assigned to a shift clock. However, since the disadvantages about high cost and the miniaturization because of the number of the parts of circuit elements cannot be eliminated, it is necessary to adopt an IC etc., for exclusive use therefor, but this method can be applied only in case of mass production.

SUMMARY

The present discharge lamp lighting apparatus or the present projector, which has a dynamic color filter is capable of carrying out high speed modulation of the brightness of a discharge lamp in synchronization with a conversion operation of sequential color light flux which is carried out by the dynamic color filter, and capable of switching modulation pattern by electric control.

The discharge lamp lighting apparatus (Ex) for initiating and lighting a discharge lamp (Ld) of a projector which displays an image by using sequential color light flux (Ox2) which is converted by a dynamic filter (Of) from light flux (Ox1) generated by the discharge lamp, wherein the discharge lamp lighting apparatus (Ex) includes an electric power supply circuit (Ux) which supplies power to the discharge lamp (Ld), a lamp voltage detection circuit (Vx) which generates a lamp voltage detection signal (Sv) by detecting lamp voltage (VL), a lamp current detection circuit (Ix) which generates a lamp current detection circuit (Si) by detecting lamp current (IL), a lamp current detection signal conversion circuit (Ai) which converts the lamp current detection signal (Si), a power supply capacity control circuit (Ud) which controls the power supply circuit (Ux) so that a difference between a lamp current correlation signal (Sj) from the lamp current detection signal conversion circuit (Ai) and a lamp current target signal (St) showing a value of current flowing through the discharge lamp (Ld) becomes small, a power supply circuit (Up) which updates the lamp current target signal (St) so that a load power value PL supplied to the discharge lamp (Ld) becomes a predetermined target power value PT, depending on the lamp voltage detection signal (Sv), and a modulation signal generation circuit (Un) which generates two or more binary modulation signals (M0, M1, . . . ), wherein the lamp current detection signal conversion circle (Ai) includes two or more switching elements (Z0, Z1, . . . ) whose ON/OFF stage is controlled in response to a truth/false of respective bits of the modulation signals (M0, M1, . . . ), in which the gain the lamp current detection signal conversion circle (Ai) is changed based on a combination of truth and false of bits of the modulation signals (M0, M1, . . . ), wherein the modulation signal generation circuit (Un) includes modulation signal resisters (F0, F1, . . . ) which holds respective bits of the modulation signals (M0, M1, . . . ), and an original modulation signal generation circuit (Uk) which generates an original modulation signal (K0, K1, . . . ) which is set in the modulation signal resister (F0, F1, . . . ), wherein the original modulation signal generation circuit (Uk) includes a modulation bit set memory unit (Ukm) in which an original modulation bit set (J0A, J1A, . . . , J0B, J1B, . . . ) for the original modulation signals (K0, K1 . . . ) is stored in relation to respective colors of the dynamic color filter (Of), wherein the modulation signal generation circuit (Un) sets the original modulation signal (K0, K1, . . . ) in the modulation signal resister (F0, F1, . . . ) in synchronization with a modulation switching timing signal (So) which is generated based on an operation of the dynamic color filter (Of) in order to specify timing for switching a modulation state, wherein the original modulation signal generation circuit (Uk) has a modulation change count section (Ukc) which counts the received modulation switching timing signal (So), and wherein when the modulation switching timing signal (So) is received, and then a next modulation switching timing signal (So) is inputted, a bit set corresponding to a counted value of the modulation change count section (Ukc) is selected from the original modulation bit set (J0A, J1A, . . . , J0B, J1B, . . . , . . . ) stored in the modulation bit set memory unit (Ukm) and the original modulation signal (K0, K1, . . . ) is updated, so as to be a value set in the modulation signal resistors (F0, F1, . . . ) and the counted value of the modulation change count section (Ukc) is updated. Here, the original modulation bit set (J0A, J1A, . . . ) and (J0B, J1B, . . . ) comprise the original modulation bits J01, J1A, . . . and J0B, J1B, . . . , respectively.

Further, in the discharge lamp lighting apparatus, the modulation switching timing signal (So) may be modulated based on the operation of the dynamic color filter (Of) in order to specify a phrase of a sequential color cycle, and the modulation signal generation circuit (Un) has an initialization information demodulation circuit (Uod) which determines whether the modulation switching timing signal (So) is modulated, and when the initialization information demodulation circuit (Uod) determine that the modulation switching timing signal (So) is modulated, an operation by which the counted value of the modulation change count section (Ukc) is initialized is set.

In the discharge lamp lighting apparatus, the original modulation signal generation circuit (Uk) may generate a current target update permission signal (Se) during a period from the modulation switching timing signal (So) in the sequential color cycle of the dynamic filter (Of) to the next modulation switching timing signal (So), and when the current target update permission signal (Se) is in an inactive state, the lamp current target signal (St) is not updated.

The discharge lamp lighting apparatus according to claim 1, further including an inverter (Ui) which drives the discharge lamp (Ld) in an alternating current manner, in which polarity of voltage applied to the discharge lamp (Ld) is inverted, and an inverter controlling circuit (Uf) which controls an operation of the inverter (Ui), wherein the inverter controlling circuit (Uf) causes the inverter (Ui) to invert the polarity when receiving the modulation switching timing signal (So) under a specific sequential color condition of the dynamic filter (Of).

In the discharge lamp lighting apparatus, wherein the inverter controlling circuit (Uf) may have an inverter polarity resister (Ufs) which holds an inverter polarity signal (Sfs) which is a bit signal corresponding to a polarity state of the inverter (Ui), and an original inverter polarity signal generation circuit (Ufr) which generates an original inverter polarity signal (Sfr) set in the inverter polarity resister (Ufs), and the original inverter polarity signal (Sfr) is set in the inverter polarity resister (Ufs) in synchronization with the modulation switching timing signal (So), wherein after the original inverter polarity signal generation circuit (Ufr) receives the modulation switching timing signal (So), the original inverter polarity signal generation circuit (Ufr) updates the original inverter polarity signal (Sfr) so as to be a value set in the inverter polarity resister (Ufs) when the next modulation switching timing signal (So) is inputted.

Moreover, in the present projector, light flux (Ox1) generated by a discharge lamp may be converted by a dynamic filter (Of) into sequential color light flux (Ox2) so that an image may be displayed by using the sequential color light flux (Ox2), wherein the discharge lamp (Ld) is initiated so as to be lighted, by the discharge lamp lighting apparatus (Ex).

The lamp current detection signal conversion circuit (Ai) may include two or more switching elements (Z0, Z1, . . . ) by which an ON/OFF state thereof is controlled according to a false/truth of each bit of the modulation signal (M0, M1, . . . ), so that the gain thereof can be changed based on a combination of a truth and false of bits of the modulation signals (M0, M1, . . . ) so as to carry out high-speed modulation of the brightness of the discharge lamp. Since in response to the modulation switching timing signal (So), a bit set according to the counted value of the modulation switch count section (Ukc) is selected from the original modulation bit set (J0A, J1A, . . . , J0B, J1B, . . . ) of the modulation bit set memory unit (Ukm), and the original modulation signal (K0, K1, . . . ) is updated, the number of parts can be reduced. In addition, modulation which is synchronized with a conversion operation of sequential color light flex which is carried out by using the dynamic filter, can be carried out without using a high speed element, and without causing delay in an operation to the conversion switching timing signal (So) or jitter. Moreover, it is possible to switch modulation patterns by electric control.

That is, it is possible to carry out high speed modulation of the brightness of the discharge lamp in synchronization with a conversion operation of the sequential color light flux which is carried out by using the dynamic color filter, and it is possible to provide a discharge lamp lighting apparatus and a projector capable of switching the modulation patterns by electric control.

If a discharge lamp lighting apparatus has the initialization information demodulation circuit (Uod), which determines whether modulation to the modulation switching timing signal (So) is carried out, it is possible to match up a cycle of appearance of the sequential color light flux with a cycle of a modulation pattern without separately providing a modulation cycle initialization signal.

If in the discharge lamp lighting apparatus, a current target update permission signal (Se) is generated, and the lamp current target signal (St) is not updated when the current target update permission signal (Se) is an inactive state, it is possible to avoid an increase in a possibility of the instability of the lamp electric power control which may be caused by the modulation of lamp current.

If polarity is inverted by the inverter (Ui) in the discharge lamp lighting apparatus when the modulation switching timing signal (So) in specific sequential color condition of the dynamic color filter (Of) is received, it is possible to avoid the problem of adverse influence on a display image due to instantaneous light-out at the time of polarity inversion, or overshoot, etc. while the polarity inversion frequency which is desirable for a discharge lamp is maintained.

If in the original inverter polarity signal generation circuit (Ufr), the modulation switching timing signal (So) is received, the original inverter polarity signal (Sfr) is updated so that the original inverter polarity signal (Sfr) may have a value to be set in the inverter polarity register (Ufs) when the modulation switching timing signal (So) is inputted next time, it is possible to provide a discharge lamp lighting apparatus capable of flexible setting of polarity inversion.

If the above-described discharge lamp lighting apparatus (Ex) is used for a discharge lamp lighting apparatus for initiating discharge and lighting the discharge lamp (Ld), it is possible to perform high-speed modulation of the brightness of a discharge lamp in synchronization with a conversion operation of the sequential color light flux which is carried out by using a dynamic color filter, and it is possible to switch modulation patterns by electric control, thereby improving color-reproduction performance, or desired color-reproduction performance of the projector.

BRIEF DESCRIPTION OF THE DRAWINGS

Other features and advantages of the present discharge lamp lighting apparatus and projector will be apparent from the ensuing description, taken in conjunction with the accompanying drawings, in which;

FIG. 3A shows a schematic timing chart showing part of an operation of a discharge lamp lighting apparatus according to an embodiment;

FIG. 3B shows a schematic timing chart thereof;

FIG. 8 is a schematic diagram showing an embodiment of part of a discharge lamp lighting apparatus;

FIG. 9 is a schematic timing chart showing part of an operation of an embodiment of a discharge lamp lighting apparatus;

FIG. 14 is a schematic diagram showing an embodiment of a discharge lamp lighting apparatus; and FIG. 15 is a schematic diagram showing part of an embodiment of a discharge lamp lighting apparatus.

DETAILED DESCRIPTION OF THE INVENTION

While the claims are not limited to the illustrated embodiments, an appreciation of various aspects of the present discharge lamp lighting apparatus and projector is best gained through a discussion of various examples thereof.

First, an embodiment of a discharge lamp lighting apparatus will be described below, referring to a block diagrams shown in FIGS. 1 and 2.

Figure 1:
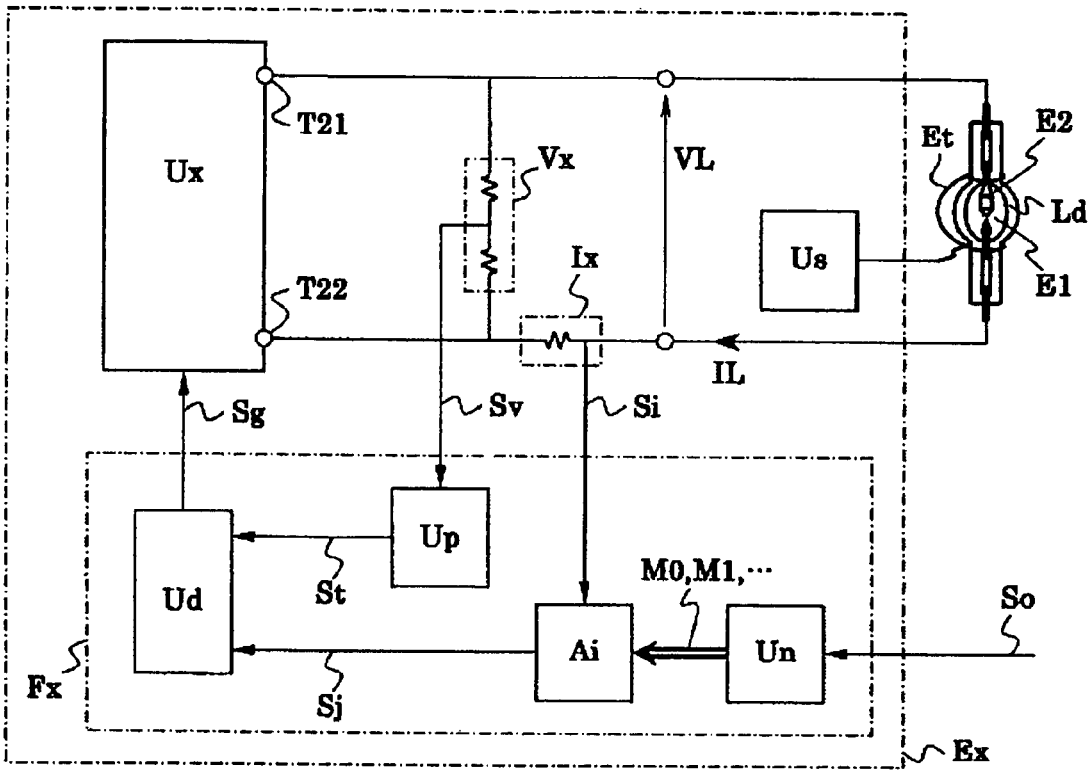
FIG. 1 is a schematic block diagram showing an example of a discharge lamp lighting apparatus according to an embodiment.

In FIG. 1, a starter (Us) for initiating electric discharge is connected to a discharge lamp (Ld). In the figure, an example of an external trigger type discharge lamp in which high voltage is applied to an auxiliary electrode (Et) provided on the exterior of a container of the discharge lamp (Ld) is shown. The type of a trigger of the discharge lamp is not significant to the essence of the embodiment. An electric supply circuit (Ux) is connected to the discharge lamp (Ld) through the electrodes (E1, E2) used for main discharge of the discharge lamp (Ld) so that electric power may be supplied to the discharge lamp (Ld) through the electrodes (E1, E2).

Output current (IL) of the electric supply circuit (Ux) i.e., the lamp current, is detected by a lamp current detection unit (Ix), whereby a lamp current detection signal (Si) is generated so as to be inputted into a lamp current detection signal conversion circuit (Ai), and to be converted to a lamp current correlation signal (Sj) which is then outputted to an electric supply capacity control circuit (Ud) (described later).

Figure 10:
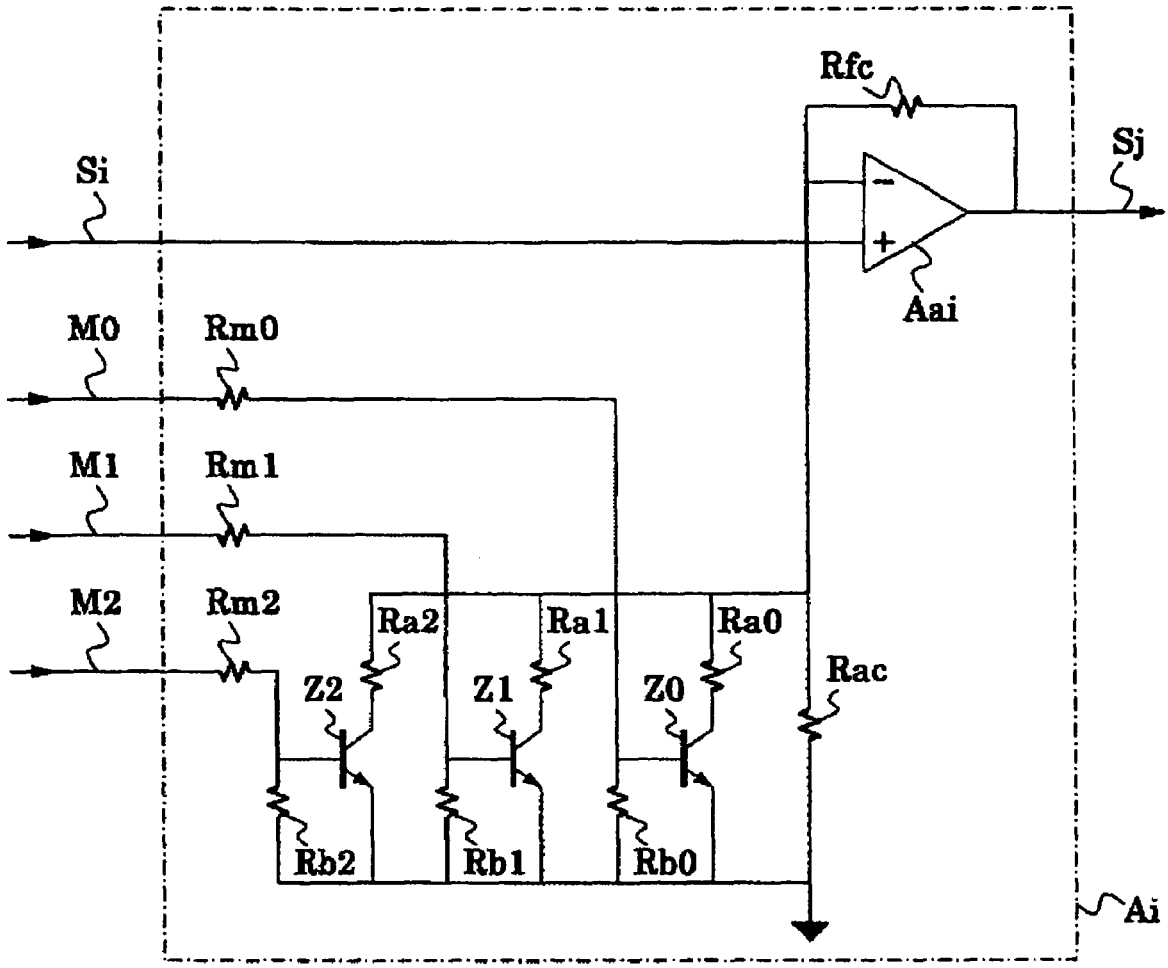
FIG. 10 is a schematic diagram showing part an embodiment of a discharge lamp lighting apparatus.

The lamp current detection signal conversion circuit (Ai) includes two or more switching elements (Z0, Z1, . . . ) therein (for example, as shown in FIG. 10). The gain of the lamp current detection signal conversion circuit (Ai), that is, the ratio of the size of the lamp current correlation signal (Sj) which is an output signal, to the size of the lamp current detection signal (Si) which is an input signal of the lamp current detection signal conversion circuit (Ai) may be variable according to combinations of ON and OFF states of the switching elements. The binary modulation signals (M0, M1, . . . ) are generated by a modulation signal generation circuit (Un), corresponding to the respective switching elements (Z0, Z1, . . . ) so that the ON/OFF state of each switching element (Z0, Z1, . . . ) is controlled, corresponding to truth/false (or false/truth) of the bit of each modulation signals (M0, M1, . . . ). That is, the gain of the lamp current detection signal conversion circuit (Ai) can be changed by a combination of truth and false of the respective bits of the modulation signals (M0, M1, . . . ).

Therefore, the lamp current detection signal conversion circuit (Ai) outputs the lamp current correlation signal (Sj) in which the gain determined by the states of the modulation signals (M0, M1, . . . ) is added to the lamp current detection signal (Si) which is an input. Since the amount of change due to the gain produced by change of the truth and false of the respective bits of the modulation signals (M0, M1, . . . ), i.e., the weight of each bit, differs depending on the bits of the modulation signals (M0, M1, . . . ), it is possible to express the gain having much gradation in less modulation signals (M0, M1, . . . ) i.e., the number of bits by choosing the weight of each bit suitably. For example, if a modulation signal comprises three bits, the gradation of gain turns into eight gradation levels. In addition, although the lamp current detection signal conversion circuit (Ai) usually comprises an amplifier, but may comprises an attenuator.

The lamp current correlation signal (Sj) and a lamp current target signal (St) which is a control target value of this signal (Si) are inputted into the electric supply capacity control circuit (Ud), and these two signals are compared with each other by the electric supply capacity control circuit (Ud). A feedback control of the electric supply circuit (Ux) based on the output of the gate driving signal (Sg) is carried out so that the lamp current (IL) may increase when the value of the lamp current correlation signal (Sj) is smaller than that of the lamp current target signal (St), and so that the lamp current (IL) may decrease when the value of the lamp current correlation signal (Sj) is larger than the lamp current target signal (St), whereby the lamp current correlation signal (Sj) and the lamp current target signal (St) are in agreement.

On the other hand, the output voltage of the electric supply circuit (Ux), i.e., lamp voltage (VL), is detected by a lamp voltage detection unit (Vx), so that a lamp voltage detection signal (Sv) is generated, and then inputted into an electric power control circuit (Up). The electric power control circuit (Up) has a function for updating the lamp current target signal (St) so that the load electric power value PL applied to the discharge lamp (Ld) may turn into a pre-determined target electric power value PT by based on the lamp voltage detection signal (Sv).

Thus, in the present discharge lamp lighting apparatus, the modulation signal generation circuit (Un) can directly change the gain of the lamp current detection signal conversion circuit (Ai) by generating a desired combination of the modulation signals (M0, M1, . . . ). As a result, since a feedback control of the electric supply circuit (Ux) is carried out by an operation of the electric supply capacity control circuit (Ud) so that immediately the lamp current (IL) is modulated, it is possible to realize high-speed modulation of the brightness of the light source.

Figure 2:
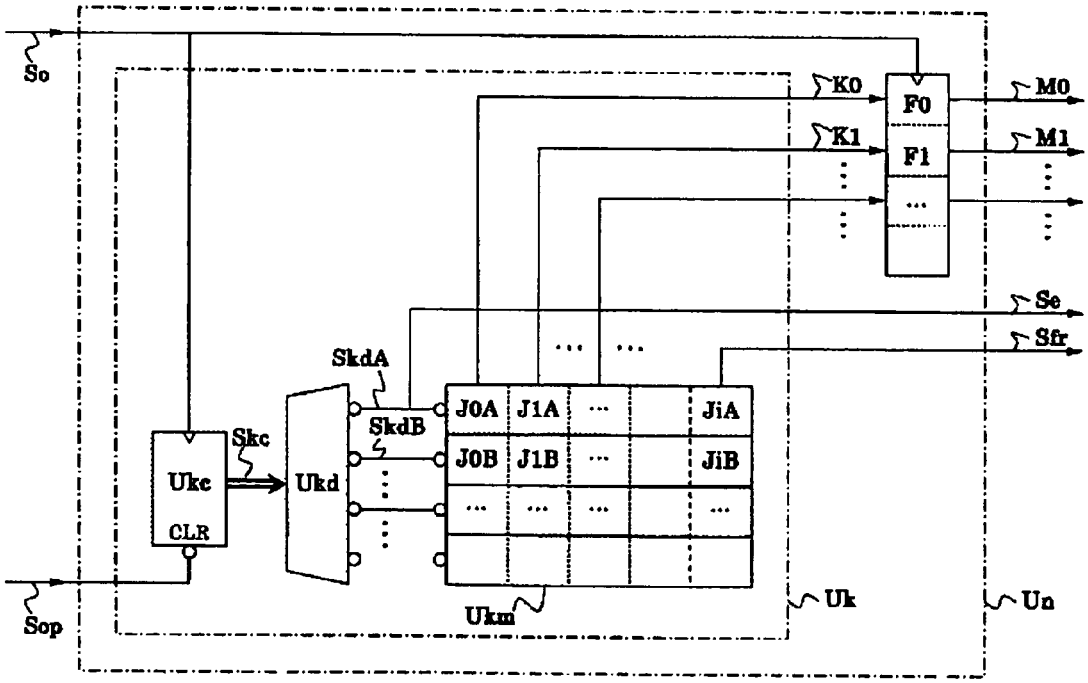
FIG. 2 is a schematic block diagram showing an embodiment of part of a discharge lamp lighting apparatus.

FIG. 2 shows the structure of the modulation signal generation circuit (Un). In order to determine timing at which the modulation state is switched, a modulation switching timing signal (So) is generated in a image-processing section provided in the projector based on an operation of the dynamic color filter (Of) and inputted into the modulation signal generation circuit (Un). Every time a modulation change count section (Ukc) provided in an original modulation signal generation circuit (Uk) receives the modulation switching timing signal (So), the holding value is incremented, that is, the modulation switching timing signal (So) is counted.

Moreover, the modulation cycle initialization signal (Sop) is generated in similar manner to that of the modulation switching timing signal (So) and is inputted into the modulation change count section (Ukc) which then clears the holding value, that is, initializes the value when receiving the signal (Sop).

In this case, the number of the modulation switching timing signal (So) within a sequential color cycle of the dynamic color filter (Of) and the digits of the modulation change count section (Ukc) (for example, base four number) are matched up to each other. For example, where the number of the modulation switching timing signals (So) within a sequential color cycle of the dynamic color filter (Of) is four, that is, a sequential color cycle comprises four colors, the modulation change count section (Ukc) is configured as a quad-decimal counter.

In a modulation bit set memory unit (Ukm), the respective value counted by the modulation change count section (Ukc), that is, the original modulation bit set (J0A, J1A . . . , J0 B, J1B . . . , . . . ), is stored, corresponding to appearing colors of the dynamic color filter (Of). For example, data comprising a bit set which has bits required for each color, is stored, that is, an original modulation bit set (J0A, J1A, . . . ) for a certain value of the count of the modulation change count section (Ukc), an original modulation bit set (J0B, J1B, . . . ) for the next value, . . . , are stored. Usually, each original modulation bit set (J0A, J1A, . . . , J0B, J1B, . . . , . . . ) is memorized, for example, as one byte data.

In responds to the counted value of the modulation change count section (Ukc), the original modulation bit set (J0A, J1A, . . . ), the original modulation bit set (J0A, J1A . . . ), or . . . , is selected, so as to be outputted from the original modulation signal generation circuit (Uk) as an original modulation signal (K0, K1, . . . ), and then to be inputted into modulation signal registers (F0, F1, . . . ). In addition, in FIG. 2, the function for selecting the corresponding bit set from the original modulation bit set (J0A, J1A, . . . , J0B, J1B, . . . , . . . ) according to the counted value of the modulation change count section (Ukc) is configured by a decoder (Ukd) for decoding the counted value (Skc) of the modulation change count section (Ukc), and activating one of selection signals (SkdA, SkdB, . . . ).

The modulation switching timing signal (So) is inputted as a data setting clock pulse into each of the modulation signal registers (F0, F1, . . . ) formed by a D flip-flop. For this reason, when the modulation switching timing signal (So) is received, the modulation signal generation circuit (Un) holds each bit value of the original modulation signal (K0, K1, . . . ) which has been inputted until immediately before receiving the modulation switching timing signal (So), and operates so as to immediately output it as the modulation signals (M0, M1, . . . ). Therefore, the original modulation signal generation circuit (Uk) receives the modulation switching timing signal (So), and based on the result of the increment of the value counted by the modulation change count section (Ukc), the original modulation signal (K0, K1, . . . ) which is selected and outputted from the modulation bit set memory unit (Ukm), is outputted from the modulation signal generation circuit (Un) as the modulation signals (M0, M1, . . . ) when the next modulation switching timing signal (So) is received.

Since, a period in which switching of the color appearing on the dynamic color filter (Of) is completed, i.e., time interval of the modulation switching timing signal (So), is about 1 ms in general, what is necessary is just to output the original modulation signal (K0, K1, . . . ) within 1 ms after the original modulation signal generation circuit (Uk) receives the modulation switching timing signal (So). Therefore, an element which performs high-speed operation is not required for the original modulation signal generation circuit (Uk), and there may be no problem even though there is variation in a period during which the output of the original modulation signal (K0, K1, . . . ) is completed after receiving the modulation switching timing signal (So), i.e., a jitter. On the other hand, since renewal of the modulation signals (M0, M1, . . . ) is performed all at once by the modulation signal registers (F0, F1, . . . ) as for all the bits, synchronizing with the modulation switching timing signal (So), the significant delay or the jitter from reception of the modulation switching timing signal (So) does not occur.

It turns out that the circuit arrangement is simplified and the number of parts thereof can be reduced, as compared with the circuit of FIG. 15. Furthermore, since it is not necessary to simultaneously output the modulation signal data for two or more colors, an IC memory such as a RAM and ROM having bit depth required for the resolution for modulation can be used, as they are, for the modulation bit set memory unit (Ukm). In this case, what is necessary is to input the counted value (Skc) of the modulation change count section (Ukc) into an address input of the IC memory, without change, and there is no necessity of providing the decoder (Ukd) as for read-out from the IC memory. Moreover, it is possible to hold, switch and use two or more modulation waveforms, i.e., modulation patterns by assigning a modulation pattern number to the high-order bit of the counted value (Skc) as a digital numerical value.

Furthermore, as described above, a high-speed operation is not required for the original modulation signal generation circuit (Uk), and since there is no problem even if there may be a jitter, a microprocessor can be used so as to form the circuit (Uk). In such a case, the circuit can be simplified, further, and two or more modulation patterns can be held and switched. In addition, it is possible to load an arbitrary pattern from an image-processing unit of a projector, using a communication function of an UART (an element for asynchronous serial communication).

Thus, according to the embodiment, high speed modulation of the brightness of the discharge lamp can be carried out, and the number of parts can be reduced. Further, a delay of an operation to a modulation switching timing signal (So) or the jitter does not occur even where a high-speed element is not used. Moreover, modulation which is synchronized with a conversion operation of the sequential color light flux which is carried by using a dynamic color filter can be performed, and a switching operation of the modulation patterns can be performed by electric control.

In the above explanation about the modulation cycle initialization signal (Sop), a path through which this signal is transmitted from the generation origin of this signal is not described concretely. Although a path which is independent of the path of the modulation switching timing signal (So) may be provided, the number of signal lines can be reduced by transmitting the modulation cycle initialization signal (Sop) using the same path as that of the modulation switching timing signal (So). Therefore, when activating the modulation cycle initialization signal (Sop), in the image-processing unit of the projector, the modulation switching timing signal (So) is modulated and sent out therefrom. However, it should be noted that "modulation" to the modulation switching timing signal (So) is different from the "modulation" to the brightness of the discharge lamp, in terms of the object and form thereof.

As a method of modulation carried on the modulation switching timing signal (So), any modulation method can be used if it is easily determined whether modulation is carried out, i.e., if it is easy to demodulate the modulated signal so as to reproduce the modulation cycle initialization signal (Sop). For example, in case that the modulation switching timing signal (So) comprising a pulse having short and long widths is transmitted, when a pulse width which is longer than predetermined time width is received, it is regarded that the modulation switching timing signal (So) is received and the signal is processed as the modulation switching timing signal (So). Conversely, when a short pulse width signal is received, it is regarded that the signal is modulated so that the modulation cycle initialization signal (Sop) is received with the modulation switching timing signal (So), and it is demodulated so as to be processed.

FIG. 3A is a schematic diagram of the structure of an initialization information demodulation circuit (Uod).

The modulation switching timing signal (So) is inputted into a mono-stable multivibrator (A11), which then outputs a pulse signal (Soa) having a predetermined time width (τ11) in response to the leading edge of the input signal. The modulation switching timing signal (So) and the pulse signal (Soa) are inputted into a logical gate (A12), and this logical gate (A12) generates a low level modulation cycle initialization signal (Sop), when the modulation switching timing signal (So) is low level and the pulse signal (Soa) is high level.

FIG. 3B is a schematic timing chart showing an operation of the initialization information demodulation circuit (Uod), wherein (a) shows the modulation switching timing signal (So), (b) shows the pulse signal (Soa), and (c) shows the modulation cycle initialization signal (Sop). Although the modulation switching timing signal (So) having a long pulse width is received at the time (t11), since the pulse signal (Soa) generated at the time (t11) has already returned to low level at the time of the end of the long pulse (So), the modulation cycle initialization signal (Sop) is still high-level. On the other hand, although the modulation switching timing signal (So) having a short pulse width is received at the time (t12), since the pulse signal (Soa) generated at the time (t12) remains high-level at the time (t13) which is the end of the pulse (So), the modulation cycle initialization signal (Sop) which has a low level time width equal to the remaining time of the pulse (Soa), that is, a period (τ11) from a time point (t13) to the end of the pulse signal (Soa) is generated.

Or as a method in which modulation is carried on the modulation switching timing signal (So), in case that, for example, the modulation switching timing signal (So) comprising a single pulse or two or more pulses are transmitted, when one pulse is received in a predetermined time period, it is regarded as the modulation switching timing signal (So) is received, and the signal is processed as the signal (So). On the other hand, when two or more pulses are received, it is recognized that modulation has been carried thereon, and it is regarded that the modulation cycle initialization signal (Sop) is also received with the modulation switching timing signal (So) so that the signal is processed for demodulation.

Figure 4A:
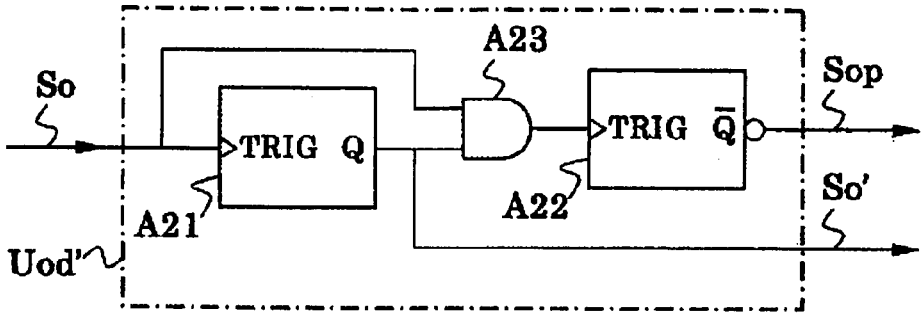
FIG. 4A shows a schematic timing chart showing part of an operation of a discharge lamp lighting apparatus according to an embodiment.

FIG. 4A is a schematic diagram of an initialization information demodulation circuit (Uod'). The modulation switching timing signal (So) is inputted into a mono-stable multivibrator (A21), and the mono-stable multivibrator (A21) outputs a pulse signal (So') having a predetermined time width (τ21) in response to the leading edge of the input signal. The modulation switching timing signal (So) and the pulse signal (So') are inputted into an AND gate (A23), and by the AND gate (A23), the leading edge of the modulation switching timing signal (So) passes therethrough so as to be inputted into a mono-stable multivibrator (A22), when the pulse signal (So') is high-level, and the mono-stable multivibrator (A22) generates a low level modulation cycle initialization signal (Sop) having a predetermined time width (τ22) in response to the leading edge of the input signal.

Figure 4B:
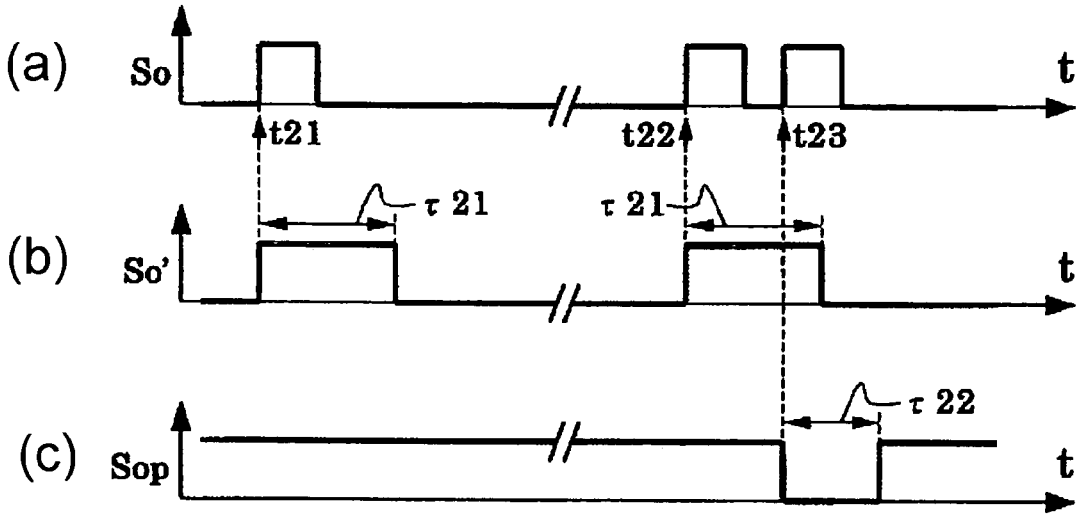
FIG. 4B shows a schematic timing chart thereof.

FIG. 4B is a schematic timing chart showing an operation of the initialization information recovery circuit (Uod'), wherein (a) shows the modulation switching timing signal (So), (b) shows the pulse signal (So'), and (c) shows the modulation cycle initialization signal (Sop). Although the modulation switching timing signal (So) comprising a single pulse is received at the time (t21), since a next modulation switching timing signal (So) is not received before the pulse signal (So') generated at the time (t21) is returned to low level, the modulation cycle initialization signal (Sop) remains high-level.

On the other hand, although the leading edge of the modulation switching timing signal (So) which consists of two or more pulses is received at the time (t22), since the pulse signal (So') generated at the time (t22) remains high-level when the second pulse is received at the time (t23), the mono-stable multivibrator (A22) is activated by the logical gate (A23), and the modulation cycle initialization signal (Sop) which has a low level time width (τ22) is generated.

What is necessary is just to use the pulse signal (So') as a substitute of the modulation switching timing signal (So) in other circuit sections of a discharge lamp lighting apparatus.

In addition, as described above, when the original modulation signal generation circuit (Uk) is configured by using a microprocessor, it is suitable to configure the initialization information recovery circuit (Uod) by using the same microprocessor. According to the embodiment, it is possible to adjust the sequential color light flux appearance cycle and the cycle of a modulation pattern, without providing a modulation cycle initialization signal, separately.

In a short term view, at the time of regular lighting, there is a feature that the lamp voltage seldom changes even if lamp current of a HID lamp changes, apart from the lamp voltage change accompanying the temperature change of the lamp or lamp voltage change in a long term view, such as shortening of a lamp life span. That is, it can be regarded that lamp voltage is constant, regardless of the current to pass, like a zener diode in approximation (zener diode approximation). Therefore, although the current of a discharge lamp whose lighting is performed by the discharge lamp lighting apparatus according to the embodiment is always changing due to modulation, it is not necessary to care about the modulation state of lamp current, when considering about acquisition timing of the lamp voltage detection signal (Sv) for determining the lamp current target signal (St) for realizing the target electric power value defined beforehand.

However, since the zener diode approximation is no more than approximation, and in a strict sense, lamp voltage also changes a little when lamp current is modulated. When the lamp voltage detection signal (Sv) is obtained without caring about the modulation state, the various disturbance of the lamp voltage resulting from the modulation of lamp current is superimposed on the lamp voltage detection signal (Sv). For this reason, the determined lamp current target signal (St) may include variation so that there is a tendency that the instability of lamp electric power control increases somewhat. In order to improve this instability, it is effective if the lamp voltage detection signal (Sv) is acquired only in a period during which the modulation signals (M0, M1, . . . ) generated by the modulation signal generation circuit, (Un) is the same value.

The original modulation signal generation circuit (Uk) generates the current target update permission signal (Se) which is activated only in a period during which the counted value of the modulation switch count section (Ukc) is a predetermined value, and when the current target update permission signal (Se) is a non-active state, an electric power control circuit (Up) is configured so that the lamp current target signal (St) is not updated. In addition, as for the generation method of the current target update permission signal (Se), it is easily realizable by choosing and using suitable one of the selection signals (SkdA, SkdB, . . . ).

FIG. 2 shows an example in which the selection signal (SkdA) is used as the current target update permission signal (Se). Thus, in such a structure according to the embodiment, it is possible to avoid an increase in the instability of the lamp electric power control which may occur due to the modulation of lamp current.

Although the embodiment is applicable to both a direct-current driving type and an alternating current driving type of discharge lamp lighting apparatus, as described above, since in the case of the alternating current driving type of discharge lamp lighting apparatus, the instantaneous light-out at the time of polarity inversions, overshoot, etc. arise thereby causing a adverse influence on a display image, it is desirable that polarity inversion is carried out at each appearing color transition of a dynamic color filter (Of). However, since phenomena, such as an instantaneous light-out at the time of polarity inversions and overshoot, are generated depending on the size of an inductance component which exists in the downstream of an inverter (Ui), if the instantaneous light-out at the time of polarity inversions, overshoot, etc. can be sufficiently suppressed to small by making this inductance component small etc., it is not necessary to use the time of the polarity inversion at each appearing color transition.

Even though polarity inversion is carried out at transition of appearing color of the dynamic color filter (Of), it is possible to carry out polarity inversions at every color transitions. However, when the frequency of the color transition, i.e., the frequency of the modulation switching timing signal (So), is too higher than the frequency of polarity inversions which is desirable for a discharge lamp, there may be problem, such as shortening of the life span of a lamp etc. In such a case, when the modulation switching timing signal (So) of the specific conditions in the color sequence of the dynamic color filter (Of) is received, the polarity-inversion frequency can be reduced by making the inverter (Ui) perform an inversion, so that this problem can be avoided.

Figure 5:
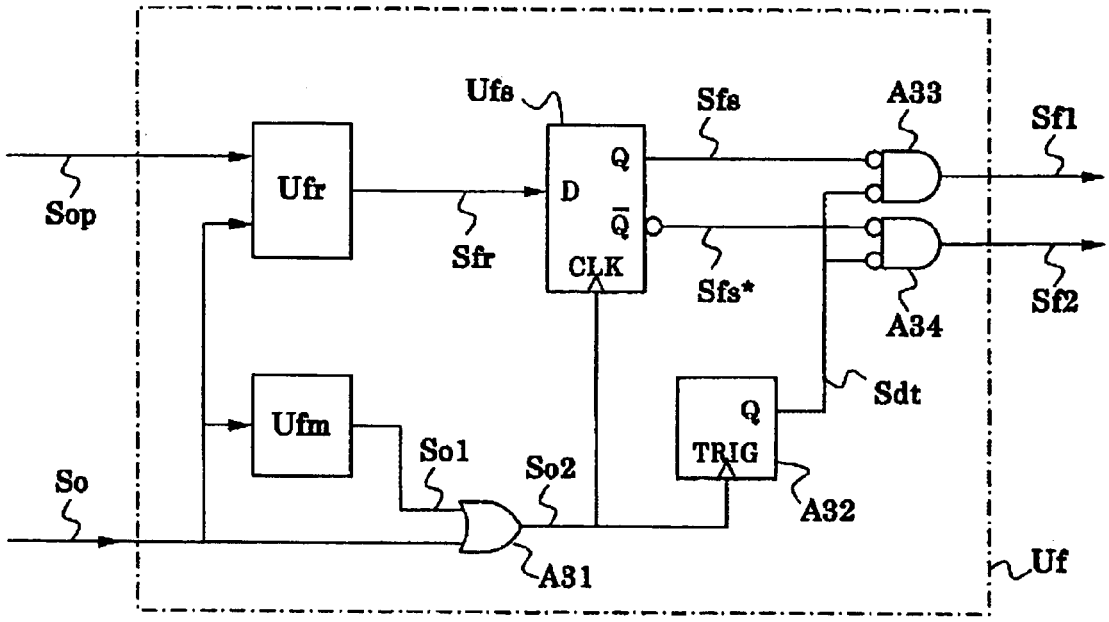
FIG. 5 shows a diagram showing an embodiment of part of a discharge lamp lighting apparatus.

FIG. 5 is a schematic diagram showing the structure of an inverter control circuit (Uf).

The inverter control circuit (Uf) has an inverter polarity register (Ufs) comprising a D flip-flop, in which an inverter polarity signal (Sfs) which is a bit signal corresponding to the polarity state of the inverter (Ui) is held. In addition, the inverter (Ui) is configured so that the inverter may have one polarity when the inverter polarity signal (Sfs) is high-level, and the inverter may have the other polarity when the signal (Sfs) is low level. The original inverter polarity signal (Sfr) generated in the original inverter polarity signal generation circuit (Ufr) is inputted into the inverter polarity register (Ufs).

The modulation switching timing signal (So) and the modulation cycle initialization signal (Sop), if needed, are inputted into the original inverter polarity signal generation circuit (Ufr), wherein, for example, the original inverter polarity signal generation circuit (Ufr) has the similar structure to the modulation switch count section (Ukc) inside thereof, and the appearing color information of the dynamic color filter (Of) can be obtained based on the counted value thereof at the time. And based on this color information, it is determined whether the polarity should be maintained or polarity should be inversed, and the new original inverter polarity signal (Sfr) is determined and outputted therefrom.

The polarity inversion timing signal (So2) which is approximately equivalent to the modulation switching timing signal (So) is inputted into the inverter polarity register (Ufs) as a data setting clock pulse. For this reason, the inverter control circuit (Uf) holds the value of the original inverter polarity signal (Sfr) which has been inputted until immediately before receiving the modulation switching timing signal (So), when the modulation switching timing signal (So) is received, and the circuit (Uf) immediately outputs the inverter polarity signal (Sfs). Therefore, the original inverter polarity signal (Sfr) which the original inverter polarity signal generation circuit (Ufr) determines by receiving the modulation switching timing signal (So) is set up in the inverter control circuit (Uf) as the inverter polarity signal (Sfs), when the next modulation switching timing signal (So) is received.

It is advantageous from a viewpoint of simplification of circuit arrangement, to generate the original inverter polarity signal (Sfr) simultaneously with generation of the original modulation signal (K0, K1, . . . ). Therefore, a section which generates the original inverter polarity signal (Sfr) is shown in FIG. 2, and in FIG. 2 the original modulation signal generation circuit (Uk) in this figure serves as the original inverter polarity signal generation circuit (Ufr) of FIG. 5.

In addition to the original modulation bit set (J0A, J1A, . . . , J0B, J1B, . . . , . . . ), an original inverter polarity bit (JiA, JiB, . . . ) used as the original inverter polarity signal (Sfr) is also stored in the modulation bit set memory unit (Ukm). And the original modulation bit set is read in the form of J0A, J1A, . . . , JiA, or J0B, J1B, . . . , JiB, etc., from the modulation bit set memory unit (Ukm), and only the original inverter polarity bit (JiA, JiB, . . . ) is separated therefrom, so as to be outputted as the original inverter polarity signal (Sfr).

For example, in case that the bit length of the modulation bit set memory unit (Ukm) is eight bits, and the bit depth of an original modulation signal (K0, K1, . . . ) is six bits, since additional information of the original inverter polarity bit (JiA, JiB, . . . ) is added only to the storage section of the remaining two bits, it is possible to add the function of the original inverter polarity signal generation circuit (Ufr) to the original modulation signal generation circuit (Uk), without any increase in the storage capacity and complexity of the sequence or the circuit structure for read-out. It is possible to separately provide the original inverter polarity signal generation circuit (Ufr) from the original modulation signal generation circuit (Uk).

In addition, although a truth and false of the original inverter polarity bit (JiA, JiB, . . . ) may be made to correspond to the high level and low level of the original inverter polarity signal (Sfr), respectively, the truth and false of the original inverter polarity bit (JiA, JiB, . . . ) may be made, for example, to correspond the inversion and the non-inversion of the original inverter polarity signal (Sfr), respectively. In the latter case, the new original inverter polarity signal (Sfr) can be generated from an "EXCLUSIVE OR operation" of the inverter polarity signal (Sfs) or the original inverter polarity signal (Sfr) generated upon reception of the previous modulation switching timing signal (So), and the read-out original inverter polarity bit.

In the OR gate (A31), the polarity inversion timing signal (So2) is generated by synthesizing the modulation switching timing signal (So) and the polarity-inversion timing complementing signal (So1) generated in the timing-signal complementing circuit (Ufm). When the modulation switching timing signal (So) which should have been transmitted from the image-processing section of a projector is not transmitted, the lamp would be damaged since direct-current is applied to the alternating-current lamp. The timing-signal complement circuit (Ufm) monitors continuously whether the modulation switching timing signal (So) is inputted as a pulse signal which has a proper time interval. If the signal (So) is not inputted, the polarity-inversion timing complementing signal (So1) is outputted as a substitution signal so that direct-current lighting of the lamp is avoided. In addition, the OR gate (A31) may serve as a data selector which selects one of the modulation switching timing signal (So) and the polarity-inversion timing complementing signal (So1).

Since renewal of the inverter polarity signal (Sfs) is performed by the inverter polarity register (Ufs), synchronizing with the modulation switching timing signal (So) as long as the modulation switching timing signal (So) is inputted normally, the significant delay or the significant jitter after reception of the modulation switching timing signal (So) does not occur. Therefore, as in the original modulation signal generation circuit (Uk), since the field inverter polarity signal generation circuit (Ufr) or the timing-signal complement circuit (Ufm) is not required to be operated at high-speed, a microprocessor can be used therefor.

In such a structure according to the embodiment, as for generation of the inverter polarity signal (Sfs), since there is sufficient time until the original inverter polarity signal generation circuit (Ufr) receives the modulation switching timing signal (So) and generates the original inverter polarity signal (Sfr), for example, when two or more patterns of modulation are held in the original modulation signal generation circuit (Uk), and switched so as to be used, flexible settings of polarity inversion, such as color transition conditions for polarity inversion, that is, switching to the optimal polarity inversion pattern become possible. Furthermore, for example, in order to control wear or growth of the electrodes of the discharge lamp, the technology (disclosed in, for example, European Patent No. EP1594156) in which a long period of a polarity-inversion cycle of the inverter (Ui) is inserted periodically may be easily used together with the embodiments.

Figure 6:
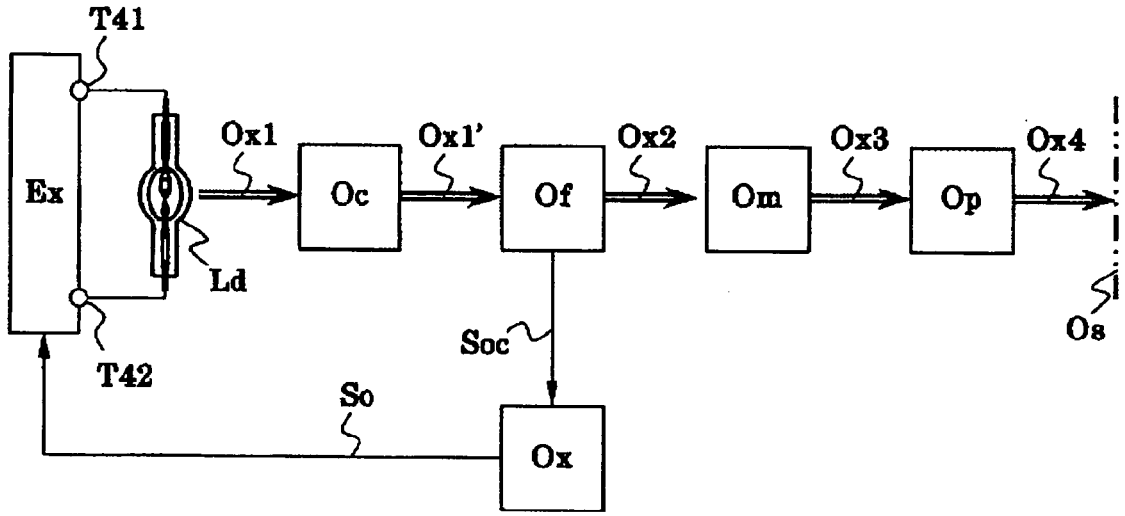
FIG. 6 shows a schematic block diagram of an embodiment of a projector.

FIG. 6 is a schematic block diagram of an embodiment of a projector. Light flux (Ox1) emitted from the discharge lamp (Ld) which is initiated and lighted by a discharge lamp lighting apparatus (Ex) according to the embodiment, becomes light flux (Ox1') after passing through a capacitor optical system (Oc) containing a concave mirror, a condenser lens, etc. provided if needed, and then is converted to the sequential color light flux (Ox2) by a dynamic color filters (Of). The sequential color light flux (Ox2) is modulated to sequential color image flux light (Ox3), by a space modulation element (Om) which uses a DMD (TM), LCD, or LCOS (reflection type liquid-crystal-display panel), etc. and a projection image (Ox4) is formed on a screen (Os) provided outside the projector, or integrally provided with the projector, by a projection lens (Op).

The image-processing section (Ox) of the projector generates the modulation switching timing signal (So), based on the signal (Soc) from a sensor corresponding to the appearing color information of the dynamic color filter (Of) such as a rotary encoder, so as to transmit it to the discharge lamp lighting apparatus (Ex). Since the discharge lamp (Ld) is lighted by the discharge lamp lighting apparatus (Ex) according to the embodiment, the brightness of the lamp (Ld) can be modulated at high speed in synchronization with an operation of conversion to the sequential color light flux which is carried out by using the dynamic color filter, and it is possible to switch the modulation patterns by electric control.

As a result, the improvement in color-reproduction performance or desired color-reproduction performance can be attained.

Next, an embodiment is explained using a diagram showing more concrete structure.

Figure 7:
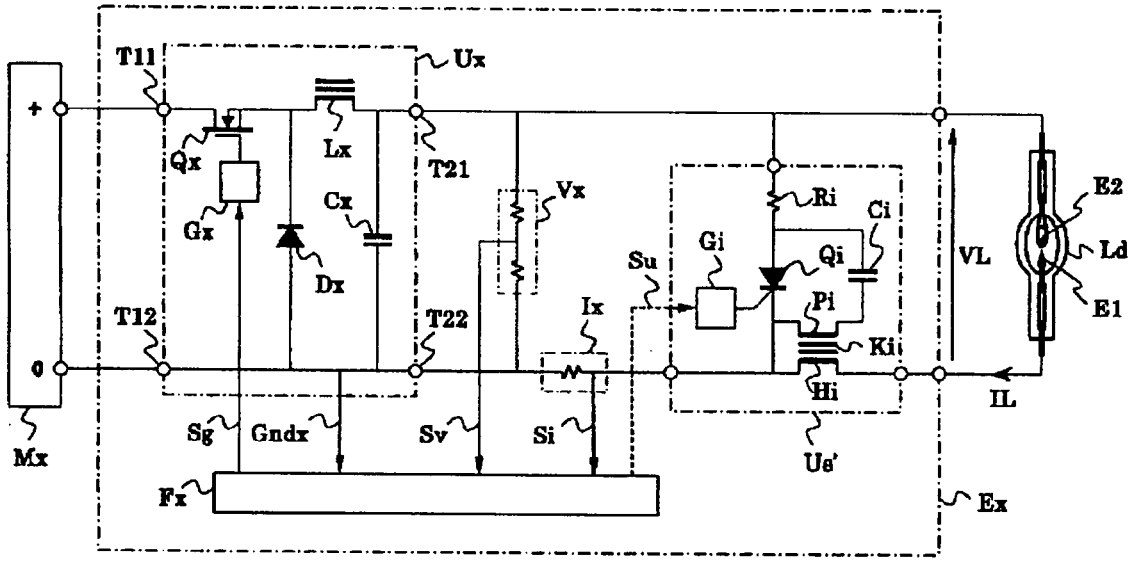
FIG. 7 is a schematic diagram showing an embodiment of a discharge lamp lighting apparatus.

FIG. 7 shows a schematic diagram of an example of a direct-current drive type discharge lamp lighting apparatus (Ex).

In the discharge lamp lighting apparatus (Ex) according to the embodiment, the electric supply circuit (Ux) which is based on a step-down chopper circuit operates in response to supply of voltage from a DC power supply (Mx), such as a PFC (power factor controller), and adjusts the amount of electric supply to a discharge lamp (Ld). In the electric supply circuit (Ux), the current from the DC power supply (Mx) is turned on and off by a switching element (Qx), such as a FET, and a smoothing capacitor (Cx) is charged through a choke coil (Lx), so that this voltage may be impressed to the discharge lamp (Ld), and the current can be passed through the discharge lamp (Ld). In addition, when the switching element (Qx) is in an on-state, the charge to a smoothing capacitor (Cx) and the current supply to the discharge lamp (Ld) are directly carried out by the current flowing through the switching element (Qx) and energy is stored in a choke coil (Lx) in form of magnetic flux. When the switching element (Qx) is in an OFF state, the current is supplied to the discharge lamp (Ld) through a flywheel diode (Dx) by the energy conserved in the choke coil (Lx) in form of magnetic flux.

In an step-down chopper type electric supply circuit (Ux), by the ratio of an ON state period of the switching element (Qx) to the operation cycle of the switching element (Qx), i.e., the duty cycle ratio, the amount of electric supply to the discharge lamp (Ld) can be adjusted. A gate driving signal (Sg) which has a certain duty cycle ratio is generated by an electric supply control circuit (Fx), and the current from the DC power supply (Mx) is turned on and off by controlling the gate terminal of the switching element (Qx) through a gate driving circuit (Gx).

In a starter (Us'), a capacitor (Ci) is charged by lamp voltage (VL) through a resistor (Ri). By activating a gate driving circuit (Gi), the switching element (Qi) which consists of a thyristor etc. becomes electrically conductive, so that the capacitor (Ci) will discharge through a primary side coil (Pi) of a transformer (Ki), thereby generating a high-voltage pulse in a secondary side coil (Hi). The high voltage generated in the secondary side coil (Hi) of the starter (Us') is superimposed on an output voltage of the electric supply circuit (Ux) so as to be impressed between electrodes (E1, E2), so that it is possible to start electric discharge of the discharge lamp (Ld). Although the trigger system in the figure differs from the trigger system of FIG. 1, the trigger system is unrelated to the essence of the embodiment.

The lamp current (IL) flowing between electrodes (E1, E2) of the discharge lamp (Ld) and the lamp voltage (VL) which is generated between the electrodes (E1, E2) are detected by a lamp current detection unit (Ix) and a lamp voltage detection unit (Vx). In addition, the lamp current detection unit (Ix) can be easily realized by using a shunt resistor, and the lamp voltage detection unit (Vx) can be realized easily by using a voltage dividing resistor. The lamp current detection signal (Si) from the lamp current detection unit (Ix) and the lamp voltage detection signal (Sv) from the lamp voltage detection unit (Vx) are inputted into the electric supply control circuit (Fx).

FIG. 8 shows a schematic diagram of the electric supply control circuit (Fx) shown in FIG. 7.

The lamp voltage detection signal (Sv) is inputted into an AD converter (Adc) in an electric power control circuit (Up), so as to be converted into digital lamp voltage data (Sxv) which has a suitable number of digits, and is inputted into a microprocessor unit (Mpu).

Here, the microprocessor unit (Mpu) includes a CPU, a program memory, a data memory, a clock pulse generating circuit, a time counter, an IO controller for input and output of a digital signal, etc.

The microprocessor unit (Mpu) generates a chopper capacity control target data (Sxt) for the electric supply capacity control circuit (Ud) which is described later, based on the condition judgment according to calculation which is referred to the lamp voltage data (Sxv), and the state of the system at the time. The chopper capacity control target data (Sxt) is changed into an analog lamp current target signal (St) by a digital-to-analog converter (Dac), and is inputted into the electric supply capacity control circuit (Ud).

Furthermore, a lamp current upper limit signal (Sk) for determining the maximum value ILmax of the lamp current (IL) is generated by a lamp current upper limit signal generating circuit (Uc), and is inputted into the electric supply capacity control circuit (Ud).

In the electric supply capacity control circuit (Ud), the lamp current target signal (St) is sent through an amplifier or a buffer (Ad1) and a diode (Dd1) which are provided if needed, to one end of a pull-up resistor (Rd1), and the lamp current upper limit signal (Sk) is sent through an amplifier, or a buffer (Ad2) and a diode (Dd2) which are provided if needed, to the one end of pull-up resistor (Rd1), thereby generating a chopper drive target signal (Sd2). In addition, the other end of the pull-up resistor (Rd1) is connected to a reference voltage source (Vd1) having suitable voltage. Therefore, the chopper drive target signal (Sd2) turns into a signal which is not the larger one between the signal (Sd3) corresponding to the lamp current target signal (St) and the signal (Sd4) corresponding to the lamp current upper limit signal (Sk).

Namely, in case that, for example, in the electric power control circuit (Up), the constant corresponding to rated power is divided by the lamp voltage data (Sxv) so as to calculate the value of the lamp current (IL) for the related power, and the lamp current target signal (St) is generated so as to correspond to this value, even when this is not appropriate, in the electric supply capacity control circuit (Ud), the chopper drive target signal (Sd2) is restricted by hardware, so that the lamp current (IL) may not exceed the lamp current upper limit signal (Sk).

The control which is carried out through the AD converter (Adc) or the microprocessor unit (Mpu) is slow in operation (or it will become high cost if high speed device is used in order to operate it at high speed). When the electric discharge state of a lamp is suddenly changed, since the lamp current target signal (St) may become inappropriate due to the delay of operation, it is useful from a viewpoint of protection of a lamp or power supply apparatus if such a current restriction function is realized by hardware configuration. On the other hand, the lamp current detection signal (Si) is converted based on the modulation signal (M0, M1, . . . ) by the lamp current detection signal conversion circuit (Ai), and is connected to the other end of a pull down resistor (Rd5) whose one end is connected to the ground (Gndx) through an amplifier, or a buffer (Ad3) and a diode (Dd3) which are provided if needed, so that a controlled object signal (Sd5) may be generated.

Furthermore, the lamp voltage detection signal (Sv) is compared with voltage of a reference voltage source (Vd2) which has voltage corresponding to no-load open circuit voltage, by a comparator (Cmv). If the lamp voltage detection signal (Sv) is higher than the non-load open circuit voltage, a transistor (Qd1) becomes an OFF state or an activity state, and the level of the controlled object signal (Sd5) may be raised by passing current through a resistor (Rd4) and a diode (Dd4) in the pull down resistor (Rd5) from the suitable source of voltage (Vd3). Conversely, when the lamp voltage detection signal (Sv) is lower than the non-load open circuit voltage, the transistor (Qd1) is turned on, so that the current from the voltage source (Vd3) is short-circuited and the controlled object signal (Sd5) becomes equivalent to the lamp current detection signal (Si). That is, in the circuit which consists of the pull down resistor (Rd5), the diode (Dd3), and the diode (Dd4), voltage corresponding to one that is not the smaller between an anode side signals (Sd6) and (Sd7) of diodes is selected and is generated in the pull down resistor (Rd5). Thus, in such a structure, even if the output current almost stops flowing so that the lamp current detection signal (Si) is inputted little, when the lamp voltage detection signal (Sv) tries to become higher than the non-load open circuit voltage, the lamp voltage (VL) is always restricted to approximately the non-load open circuit voltage or less in a hardware manner, due to rapid increase of the controlled object signal (Sd5).

The chopper drive target signal (Sd2) is divided by resistors (Rd2) and (Rd3), and is inputted into the inversion input terminal of an operational amplifier (Ade). On the other hand, the controlled object signal (Sd5) is inputted into the non-inversion input terminal of the operational amplifier (Ade). Since the output signal (Sd1) of the operational amplifier (Ade) is fed back to the inversion input terminal thereof through an integrating capacitor (Cd1) and a speedup resistor (Rd6), the operational amplifier (Ade) serves as an error integrating circuit which integrates the difference of the voltage of the controlled object signal (Sd5) and the divided voltage by the resistors (Rd2) and (Rd3) of the chopper drive target signal (Sd2).

An oscillator (Osc) to which a capacitor (Cd0) and a resistor (Rd0) are connected (a time constant is determined by the capacitor (Cd0) and the resistor (Rd0)) generates a saw-tooth waveform signal (Sd0) as shown as (a) in FIG. 9, and the saw-tooth waveform signal (Sd0) and the output signal (Sd1) of the error integrating circuit are compared by a comparator (Cmg). However, upon the comparison, the signal (Sd8) which is formed by adding offset voltage (Vd4) to the output signal (Sd1) of the error integrating circuit and the saw-tooth waveform signal (Sd0) are compared with each other. A gate driving signal (Sg) which becomes high-level in a period during which the voltage of the saw-tooth waveform signal (Sd0) is higher than the voltage of the signal (Sd8) is generated, and outputted from the electric supply capacity control circuit (Ud). As described above, since the signal (Sd8) is a signal to which offset is added to the output signal (Sd1) of the error integrating circuit, even if the output signal (Sd1) of the error integrating circuit is zero, the duty cycle ratio of the gate driving signal (Sg) is set so as to become a certain maximum value or less, which is smaller than 100%, i.e., the maximum duty cycle ratio Dxmax or less.

In FIG. 9, (a) and (b) show the relation among the output signal (Sd1) of the error integrating circuit, the signal (Sd8) which is formed by adding an offset to this signal, the saw-tooth waveform signal (Sd0), and the gate driving signal (Sg).

The gate driving signal (Sg) outputted from the electric supply control circuit (Fx) is inputted into the gate driving circuit (Gx) as shown in FIG. 7, so that the feedback control system by which the lamp current detection signal (Si) and the lamp voltage detection signal (Sv) are fed back to an operation of a switching element (Qx) may be formed. In addition, in the configuration of the electric supply capacity control circuit (Ud) shown in FIG. 8, a commercially available integrated circuit such as TL494 (TEXAS INSTRUMENTS, INC.) etc., in which an operational amplifier (Ade), an oscillator (Osc), a comparator (Cmg), etc. are integrated can be used.

In FIG. 8, as an example, a current target updated permission signal (Se) generated in the original modulation signal generation circuit (Un) is inputted into the microprocessor unit (Mpu) which generates the lamp current target signal (St). Although as described above, it is possible to select and use a suitable one of the selection signals (SkdA, SkdB, . . . ) in order to generate the current target update permission signal (Se), it is possible to store a permission bit used as the current target update permission signal (Se) as in the above-described technology in which the original inverter polarity bit (JiA, JiB, . . . ) used as the original inverter polarity signal (Sfr) is also stored in the modulation bit set memory unit (Ukm) in addition to the original modulation bit set (J0A, J1A . . . , J0B, J1B . . . , . . . ). In addition, when the microprocessor unit (Mpu) serves as the original modulation signal generation circuit (Uk), such generation and practical use of the current target update permission signal (Se) is accomplished by an operations on a program.

FIG. 10 shows a schematic diagram of the lamp current detection signal conversion circuit (Ai) shown in FIG. 8.

In the figure, the lamp current detection signal conversion circuit is formed based on a non-inversion amplifying circuit formed by an operational amplifier (Aai), and the lamp current detection signal (Si) is amplified by the operational amplifier (Aai), so that the lamp current correlation signal (Sj) is generated as an output signal.

Since the output of the operational amplifier (Aai) is divided by a resistor (Rfc) and a combined resistor (Rac) and resistors which are in parallel connected to the resistor (Rac) and which are also connected to the ground, and the amplifier (Aai) is connected to the inversion input terminal of the operational amplifier (Aai), the gain of non-inversion amplifying circuit is determined by division ratio thereof. Since switching elements (Z0, Z1, Z2) (transistors) are provided respectively, between the resistors (Ra0, Ra1, Ra2) connected in parallel to the resistor (Rac), and the ground, and since the resistors (Ra0, Ra1, Ra2) are connected or disconnected when the switching elements (Z0, Z1, Z2) are turned on or off, respectively, it is possible to change the gain of this non-inversion amplifying circuit.

Since the base terminals of the switching elements (Z0, Z1, Z2) are connected to the respective modulation signals (M0, M1, M2) through the respective base resistors (Rm0, Rm1, Rm2), an ON/OFF state of each switching element (Z0, Z1, Z2), is controlled, corresponding to the truth/false of each bit of the modulation signal (M0, M1, M2), so that it is possible to change the gain of the non-inversion amplifying circuit based on a combination of the truth/false of each bit of the modulation signal (M0, M1, M2).

In the relations of the resistors (Ra0, Ra1, Ra2), by setting up the resistance of the resistor (Ra0) twice the resistance of resistor (Ra1), and the resistance of the resistor (Ra1) twice the resistance of the resistor (Ra2), it is possible to change the gain of this non-inversion amplifying circuit as binary number data of three bits in which the modulation signal (M0) is set as the least significant bit, and the modulation signal (M2) is set as the most significant bit. However, there are no direct relation between the binary number data and the gain of the non-inversion amplifying circuit.

In addition, although an example of bits is described above, the number of bits may be increased if needed.

Figure 11:
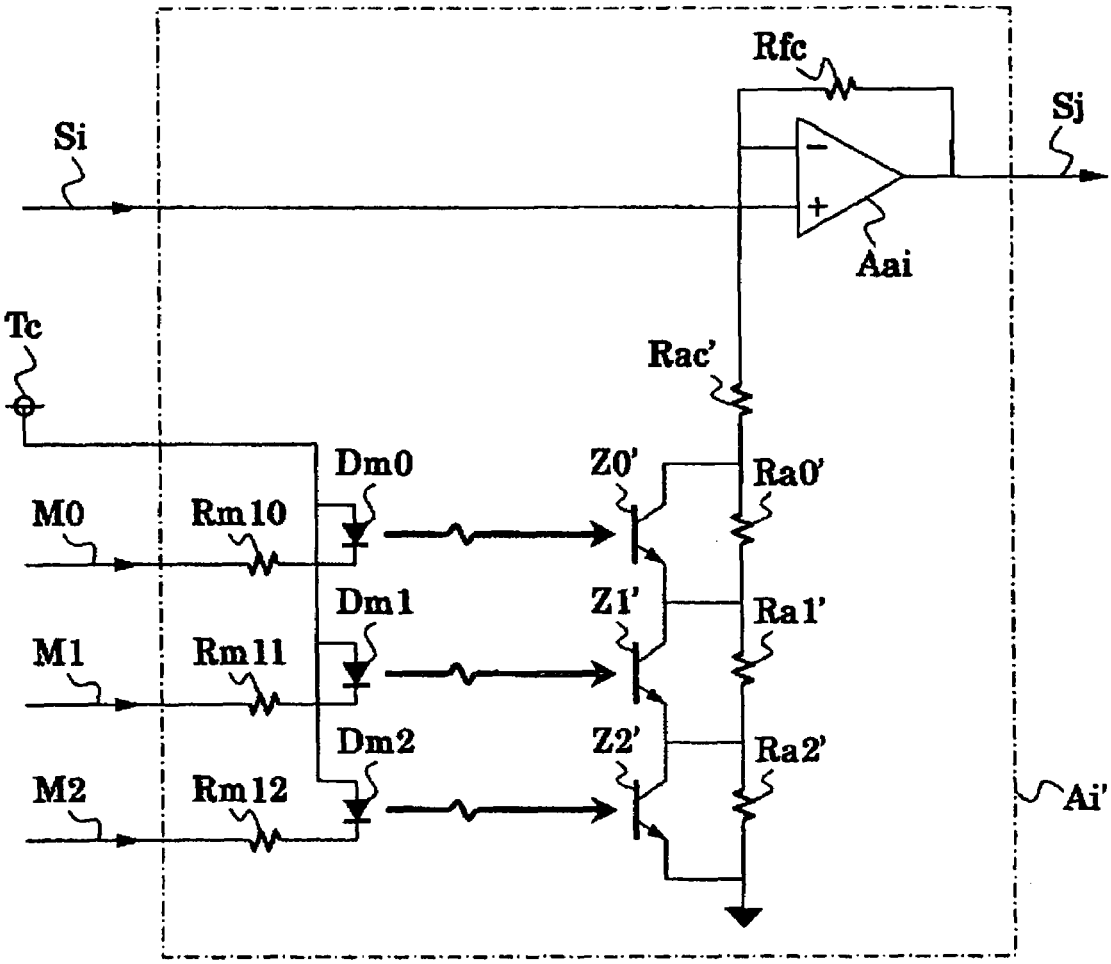
FIG. 11 is a schematic diagram showing part of an embodiment of a discharge lamp lighting apparatus.

Although an example of the lamp current detection signal conversion circuit (Ai) which is formed based on a non-inversion amplifying circuit formed by an operational amplifier is shown in FIG. 10, similarly, an example of a lamp current detection signal conversion circuit based on a non-inversion amplifying circuit formed by an operational amplifier is shown in FIG. 11. Although, in FIG. 10, the resistors (Rac, Ra0, Ra1, Ra2) which are in parallel connected to one another, in FIG. 11, resistors (Ra0', Ra1', Ra2', Rac') may be in series connected. Since the resistors (Ra0', and Ra1' and Ra2') are switched respectively between a short-circuit state and non-short-circuit state, by turning on and off the switching elements (Z0', Z1', and Z2') which are transistors made up of photo couplers, respectively, it is possible to change the gain of this non-inversion amplifying circuit.

LEDs (Dfi, Dm0, Dm1, Dm2) of photo couplers which control the ON/OFF state of the respective switching elements (Z0', Z1', and Z2') are driven through a power supply terminal (Tc) and resistors (Rm10, Rm11, Rm12) by the modulation signals (M0, M1, M2).

Figure 12:
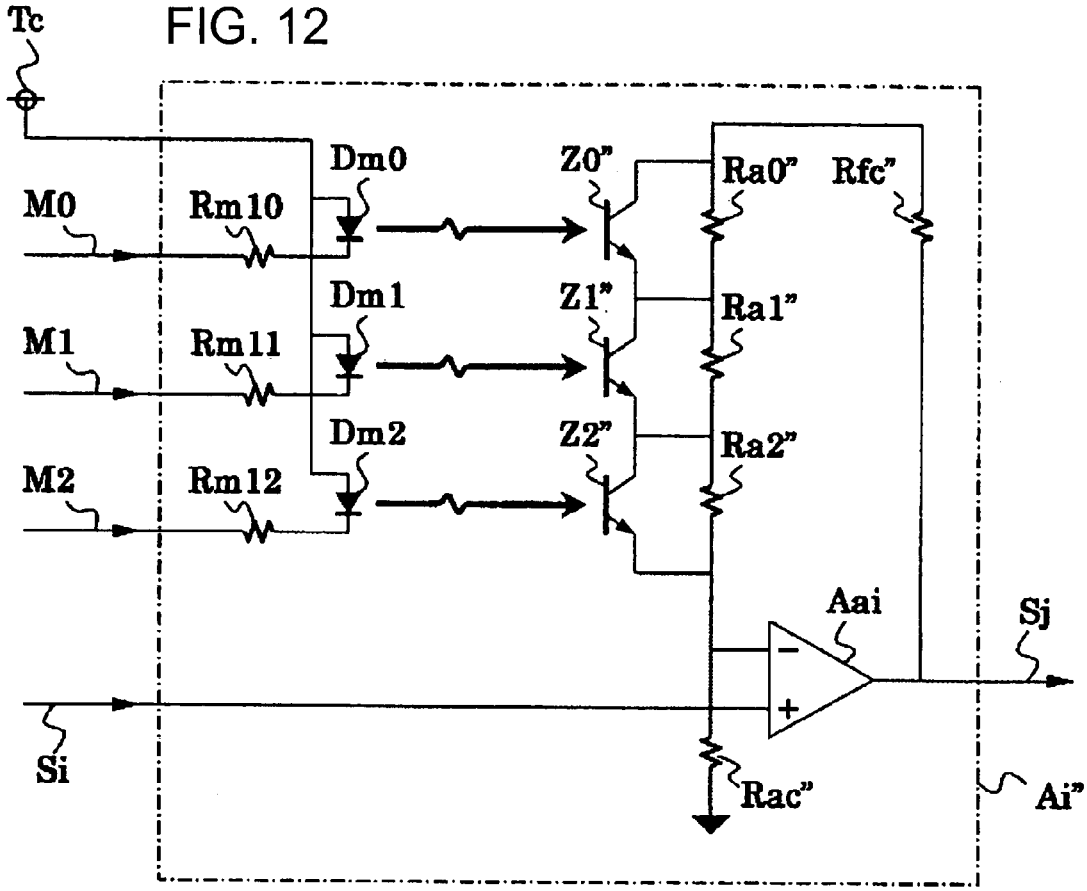
FIG. 12 is a schematic diagram showing part of an embodiment of a discharge lamp lighting apparatus.

Similarly, an example of the lamp current detection signal conversion circuit based on a non-inversion amplifying circuit formed by an operational amplifier is shown in FIG. 12.

the gain of the non-inversion amplifying circuit is made variable by changing the combined resistors connected to the ground side in FIG. 11. However, the resistance of resistor (Rac") connected to the ground side in FIG. 12 may be fixed, and the feedback side resistors may comprise resistors (Rao", Ra1", Ra2", Rfc"), and further, since a short-circuit state and a non-short-circuit state of each resistor (Ra0", Ra1", and Ra2") is switched by turning on or off the switching elements (Z0", Z1", and Z2", . . . ), each of which is a transistor made up of a photo coupler, it is possible to change the gain of this non-inversion amplifying circuit.

Thus, in the discharge lamp lighting apparatus according to the embodiment, as various types of structures can be used for the lamp current detection signal conversion circuit (Ai, Ai', Ai"). For example, one based on an inverting amplifier, or one that does not use any amplifier can be used besides those based on a non-inversion amplifier. In the above description, two or more switching elements (Z0, Z1, . . . ), in each of which a ON/OFF state is controlled corresponding to the truth/false of each bit of the modulation signal (M0, M1, . . . ), are provided, and a switching element is assigned to each modulation signal (M0, M1, M2). Namely, in the above embodiment, the ON/OFF state of the switching element (Z0) is controlled, corresponding to the truth/false of the modulation signal (M0), the ON/OFF state of the switching element (Z1) is controlled, corresponding to the truth/false of the modulation signal (M1), and the ON/OFF state of the switching element (Z2) is controlled, corresponding to the truth/false of the modulation signal (M2). Two or more switching elements may be assigned to each modulation signal (M0, M1, . . . ).

Figure 13:
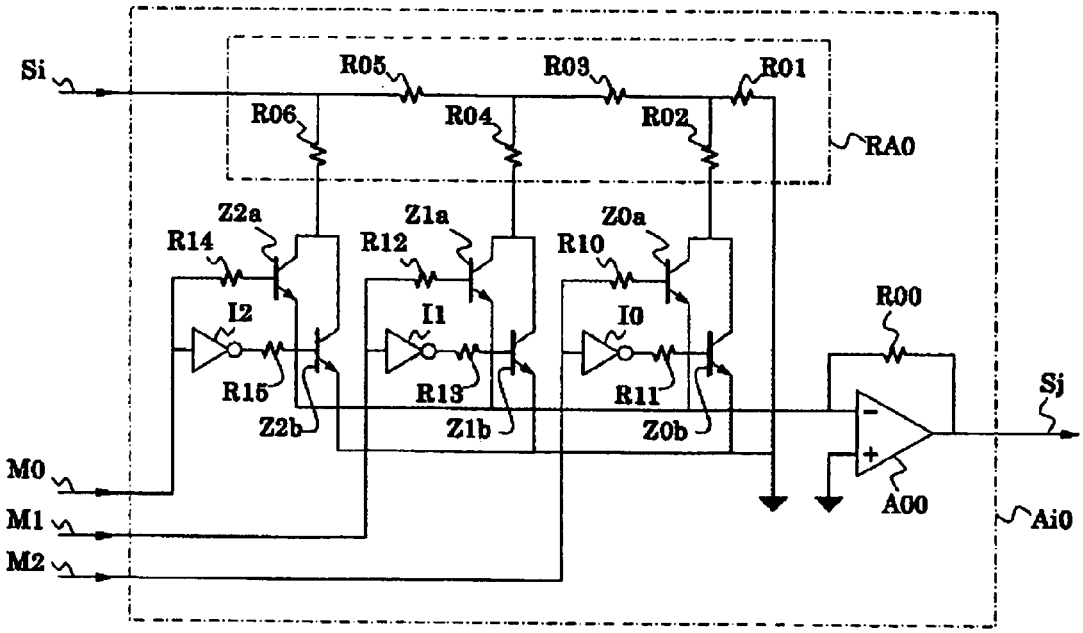
FIG. 13 is a schematic diagram showing part of an embodiment of a discharge lamp lighting apparatus.

For example, two switching elements corresponding to each modulation signal (M0, M1, and M2) may be provided as shown in FIG. 13. That is, the ON/OFF state of each switching element (Z0*a*, Z0*b*) is controlled corresponding to the truth/false of the modulation signal (M0), the ON/OFF state of each switching element (Z1*a*, Z1*b*) is controlled, corresponding to the truth/false of the modulation signal (M1), and the ON/OFF state of each switching element (Z2*a*, Z2*b*) is controlled, corresponding the truth/false of the modulation signal (M2).

In case of the lamp current detection signal conversion circuit (Ai0) shown in FIG. 13, the ON/OFF state of each switching element (Z0*a*, Z1*a*, Z2*a*) is controlled, corresponding to the truth/false of each bit of the modulation signal (M0, M1, M2). On the other hand, since the inverters (I0, I1, I2) are connected to the respective bases of the switching elements (Z0*b*, Z1*b*, Z2*b*), if one of a switching element (Z0*a*) and a switching element (Z0*b*) is in an ON state, the other one is in an OFF state, if one of the switching element (Z1*a*) and the switching element (Z1*b*) is in an ON state, the other one is in an OFF state, and if one of the switching element (Z2*a*) and the switching element (Z2*b*) is in an ON state, the other one is in an OFF state. Moreover, as shown in FIG. 13, it is also possible to use, for example, an IC for a DA conversion or a rudder resistor network (RA0).

Since electric discharge of the discharge lamp is not stabilized in a period in which a lamp voltage is low at beginning of discharge or just after the beginning of the discharge, even if the modulation switching timing signal (So) is transmitted from an image-processing section of a projector, it is desirable that the modulation signal generation circuit (Un) generate the modulation signals (M0, M1, . . . ) under a certain condition, so that the modulation of lamp current may not be carried out substantially. In addition, in FIG. 7, although the electric supply circuit (Ux) based on a step-down chopper type DC-DC converter is shown, the electric supply circuit (Ux) may be formed by an arbitrary electric power supply circuit, for example, one that uses a transformer or a resonance circuit, or other type converters such as a step-up chopper type or an inverting (or step-down) chopper type converter.

Description of an embodiment of a discharge lamp lighting apparatus will be given below, referring to FIG. 14, which is a schematic view thereof. The figure shows a full bridge system inverter (Ui) provided in the downstream side of an electric supply circuit (Ux).

The inverter (Ui) is made up of a full bridge circuit which uses switching elements (Q1, Q2, Q3, Q4), such as FETs. The switching elements (Q1, Q2, Q3, and Q4) are driven by the respective gate driving circuit (G1, G2, G3, and G4). In a phase where the switching element (Q1) and the switching element (Q3) which form one pair of diagonal elements are in an ON state in the gate driving circuits (G1, G2, G3, G4), the switching element (Q2) and the switching element (Q4) of the other pair of diagonal elements are maintained in an OFF state. Conversely, in a phase where the switching element (Q2) and the switching element (Q4) which form the other pair of diagonal elements are in an ON state, the switching element (Q1) and the switching element (Q3) which form the one pair of diagonal elements are controlled by the inverter control signals (Sf1, Sf2) generated by the inverter control circuit (Uf) so that the OFF state may be maintained. When switching the phases between them, a dead time, that is, a period in which all the switching elements (Q1, Q2, Q3, and Q4) are in an Off state, is inserted.

In addition, in case that the switching elements (Q1, Q2, Q3, Q4) are formed by, for example, MOSFETs, a parasitism diode which has a forward direction characteristic which is a direction from a source terminal toward a drain terminal is built in each of the element itself (not shown). In case of an element like a bipolar transistor which does not have such a parasitism diode, since the induced current which is attributed to an inductance component existing in the downstream side of the inverter (Ui), tends to flow at time of switching of phase or during a dead time so that there is a possibility that an element may be damaged by generation of reverse voltage, it is desirable to connect a diode which is equivalent to the parasitism diode in reverse-parallel.

In a trigger drive circuit (Us1), a capacitor (Ce) is charged by the output voltage of the electric supply circuit (Ux) through a resistor (Re). For example, if a gate driving circuit (Ge) is activated in response to a trigger signal (not shown) generated by the microprocessor unit (Mpu) etc., when the switching element (Qe) which consists of a thyristor etc. becomes conductive, the capacitor (Ce) discharges through a primary side coil (Pe) of a high-voltage transformer (Te), and a high-voltage pulse is generated in a secondary side coil (He). The high voltage generated in the secondary side coil (He) is impressed to an auxiliary electrode (Et) of a discharge lamp (Ld), so that electric discharge can be initiated between the electrodes (E1, E2) of the discharge lamp (Ld).

Moreover, the lighting nature of the discharge lamp (Ld) can be improved by adding a transformer (Th) for reinforcing a no-load open circuit voltage impressed to the electrodes (E1, E2) for main electric discharge when a high-voltage transformer (Te) is operated. A capacitor (Ch) is added to the trigger drive circuit (Us1), and is connected to a connection node of a resistor (Re) and a switching element (Qe), together with a capacitor (Ce), and the capacitor (Ch) may be charged through the primary side coil (Ph) of the transformer (Th).

Therefore, when pulse current flows through the primary side coil (Pe) of the high-voltage transformer (Te) and a high-voltage pulse is impressed to the auxiliary electrode (Et), pulse current flows similarly through a primary side coil (Ph) of the transformer (Th), and voltage is generated in a secondary side coil (Sh), so as to be superimposed on the non-load open circuit voltage impressed to the electrode (E1, E2) from an electric supply circuit (Ux). Consequently, the lighting nature of a discharge lamp (Ld) is improved.

In an alternating current driving type discharge lamp lighting apparatus, a lamp voltage detection unit (Vx) and a lamp current detection unit (Ix) are provided in the upstream side of the inverter (Ui), as shown in FIG. 14, and it is suitable that a lamp voltage detection signal (Sv) and a lamp current detection signal (Si) are acquired as signals corresponding to the absolute value of lamp voltage and lamp current, respectively.

As shown in FIG. 5, the inverter control signals (Sf1, Sf2) by the inverter control circuit (Uf) are generated, based on an inverter polarity signal (Sfs) and an inverter polarity signal logic inversion signal (Sfs*) which is a logic inversion signal of the signal (Sfs). However, since in the polarity inversion timing signal (So2) which is a clock signal of the inverter polarity register (Ufs) is inputted into a mono-stable multivibrator (A32) so that a dead time period may be inserted, and the mono-stable multivibrator (A32) generates the dead time signal (Sdt) having a fixed time width in response to the leading edge of an input signal. Since the inverter polarity signal (Sfs) and the inverter polarity signal logic inversion signal (Sfs*) are inputted into NOR logical gates (A33, A34), and since the dead time signal (Sdt) is inputted thereto, the inverter control signals (Sf1, Sf2) mutually separated by the dead time period are generated.

In order to explain an operation, or function of the light source apparatus according to the embodiments, an example of these elements are described above. Therefore, it is the assumption that details of the circuit arrangement or an operation, for example, the polarity of a signal, selection, addition or omission of concrete circuit elements, or originality and creativity, such as modification based on the procurement convenience or economic reason, are determined at the time of the design of an actual apparatus.

It is also an assumption that mechanism for especially protecting circuit elements, such as switching elements (for example, FET etc.) of power supply apparatus, from breakage factors, such as an overvoltage, an overcurrent, or overheating, or the mechanism for reducing generation of the radiation noise or conduction noise generated with an operation of the circuit element of power supply apparatus, or for not making noise to the outside, for example, a snubber circuit or a varistor, a clamp diode, a current restriction circuit (including a pulse bypass type), a common or normal mode noise filter choke coil, a noise filter capacitor, etc. are added to the circuit arrangement described above, if needed. The structure of the discharge lamp lighting apparatus according to the above embodiment is not limited to the circuit described above, and waveforms are not limited to those shown in the timing charts.

As described above, for example, in the electric power control circuit (Up) of the electric supply control circuit (Fx) in FIG. 1, the AD conversion of the lamp voltage detection signal (Sv) corresponding to lamp voltage (VL) is carried out and, based thereon, the lamp current target signal (St) is set up. On the other hand, by carrying out the AD conversion of the lamp current detection signal (Si) corresponding to lamp current (IL), and compensating and setting up the lamp current target signal (St), so that the acquired current value may be in agreement with a target current value, it is possible to apply the above embodiment to various light source apparatuses with high precision or high performance such as compensation of affects of parameter variation of each circuit element. It is advantageous that if the embodiments are applied to a light source apparatus, in which a microprocessor unit (Mpu) is eliminated so that a simple control circuit is used therein.

The preceding description has been presented only to illustrate and describe exemplary embodiments of the apparatus or projector of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A discharge lamp lighting apparatus for initiating and lighting a discharge lamp of a projector which displays an image by using sequential color light flux which is converted by a dynamic filter from light flux generated by the discharge lamp, wherein the discharge lamp lighting apparatus includes a power supply circuit which supplies power to the discharge lamp, a lamp voltage detection circuit which generates a lamp voltage detection signal by detecting lamp voltage, a lamp current detection circuit which generates a lamp current detection circuit by detecting lamp current, a lamp current detection signal conversion circuit which converts the lamp current detection signal, a power supply capacity control circuit which controls the power supply circuit so that a difference between a lamp current correlation signal from the lamp current detection signal conversion circuit and a lamp current target signal showing a value of current flowing through the discharge lamp becomes small, a power supply circuit which updates the lamp current target signal so that a load power value supplied to the discharge lamp becomes a predetermined target power value, depending on the lamp voltage detection signal, and a modulation signal generation circuit which generates two or more binary modulation signals, wherein the lamp current detection signal conversion circle includes two or more switching elements whose ON/OFF stage is controlled in response to a truth/false of respective bits of the modulation signals, in which the gain the lamp current detection signal conversion circle is changed based on a combination of truth and false of bits of the modulation signals, wherein the modulation signal generation circuit includes a modulation signal resister which holds respective bits of the modulation signals, and an original modulation signal generation circuit which generates an original modulation signal which is set in the modulation signal resister, wherein the original modulation signal generation circuit includes a modulation bit set memory unit in which an original modulation bit set for the original modulation signals is stored in relation to respective colors of the dynamic color filter, wherein the modulation signal generation circuit sets the original modulation signal in the modulation signal resister in synchronization with a modulation switching timing signal which is generated based on an operation of the dynamic color filter in order to specify timing for switching a modulation state, wherein the original modulation signal generation circuit has a modulation change count section which counts the received modulation switching timing signal, and wherein when the modulation switching timing signal is received, and then a next modulation switching timing signal is inputted, a bit set corresponding to a counted value of the modulation change count section is selected from the original modulation bit set stored in the modulation bit set memory unit and the original modulation signal is updated, so as to be a value set in the modulation signal resistors and the counted value of the modulation change count section is updated.

2. A projector in which light flux generated by a discharge lamp is converted by a dynamic filter into sequential color light flux so that an image is displayed by using the sequential color light flux, wherein the discharge lamp is initiated so as to be lighted, by the discharge lamp lighting apparatus according to claim 1.

3. The discharge lamp lighting apparatus according to claim 1, further including an inverter which drives the discharge lamp in an alternating current manner, in which polarity of voltage applied to the discharge lamp is inverted, and an inverter controlling circuit which controls an operation of the inverter, wherein the inverter controlling circuit causes the inverter to invert the polarity when receiving the modulation switching timing signal under a specific sequential color condition of the dynamic filter.

4. The discharge lamp lighting apparatus according to claim 3, wherein the inverter controlling circuit has an inverter polarity resister which holds an inverter polarity signal which is a bit signal corresponding to a polarity state of the inverter, and an original inverter polarity signal generation circuit which generates an original inverter polarity signal set in the inverter polarity resister, and the original inverter polarity signal is set in the inverter polarity resister in synchronization with the modulation switching timing signal, and wherein after the original inverter polarity signal generation circuit receives the modulation switching timing signal, the original inverter polarity signal generation circuit updates the original inverter polarity signal so as to be a value set in the inverter polarity resister when the next modulation switching timing signal is inputted.

5. The discharge lamp lighting apparatus according to claim 1, wherein the modulation switching timing signal is modulated based on the operation of the dynamic color filter in order to specify a phrase of a sequential color cycle, and the modulation signal generation circuit has an initialization information demodulation circuit which determines whether the modulation switching timing signal is modulated, and when the initialization information demodulation circuit determine that the modulation switching timing signal is modulated, an operation by which the counted value of the modulation change count section is initialized is set.

6. The discharge lamp lighting apparatus according to claim 5, further including an inverter which drives the discharge lamp in an alternating current manner, in which polarity of voltage applied to the discharge lamp is inverted, and an inverter controlling circuit which controls an operation of the inverter, wherein the inverter controlling circuit causes the inverter to invert the polarity when receiving the modulation switching timing signal under a specific sequential color condition of the dynamic filter.

7. The discharge lamp lighting apparatus according to claim 6, wherein the inverter controlling circuit has an inverter polarity resister which holds an inverter polarity signal which is a bit signal corresponding to a polarity state of the inverter, and an original inverter polarity signal generation circuit which generates an original inverter polarity signal set in the inverter polarity resister, and the original inverter polarity signal is set in the inverter polarity resister in synchronization with the modulation switching timing signal, and wherein after the original inverter polarity signal generation circuit receives the modulation switching timing signal, the original inverter polarity signal generation circuit updates the original inverter polarity signal so as to be a value set in the inverter polarity resister when the next modulation switching timing signal is inputted.

8. The discharge lamp lighting apparatus, according to claim 1, wherein the original modulation signal generation circuit generates a current target update permission signal during a period from the modulation switching timing signal in the sequential color cycle of the dynamic filter to the next modulation switching timing signal, and when the current target update permission signal is in an inactive state, the lamp current target signal is not updated.

9. The discharge lamp lighting apparatus according to claim 8, further including an inverter which drives the discharge lamp in an alternating current manner, in which polarity of voltage applied to the discharge lamp is inverted, and an inverter controlling circuit which controls an operation of the inverter, wherein the inverter controlling circuit causes the inverter to invert the polarity when receiving the modulation switching timing signal under a specific sequential color condition of the dynamic filter.

10. The discharge lamp lighting apparatus according to claim 9, wherein the inverter controlling circuit has an inverter polarity resister which holds an inverter polarity signal which is a bit signal corresponding to a polarity state of the inverter, and an original inverter polarity signal generation circuit which generates an original inverter polarity signal set in the inverter polarity resister, and the original inverter polarity signal is set in the inverter polarity resister in synchronization with the modulation switching timing signal, and wherein after the original inverter polarity signal generation circuit receives the modulation switching timing signal, the original inverter polarity signal generation circuit updates the original inverter polarity signal so as to be a value set in the inverter polarity resister when the next modulation switching timing signal is inputted.

11. The discharge lamp lighting apparatus, according to claim 5, wherein the original modulation signal generation circuit generates a current target update permission signal during a period from the modulation switching timing signal in the sequential color cycle of the dynamic filter to the next modulation switching timing signal, and when the current target update permission signal is in an inactive state, the lamp current target signal is not updated.

12. The discharge lamp lighting apparatus according to claim 11, further including an inverter which drives the discharge lamp in an alternating current manner, in which polarity of voltage applied to the discharge lamp is inverted, and an inverter controlling circuit which controls an operation of the inverter, wherein the inverter controlling circuit causes the inverter to invert the polarity when receiving the modulation switching timing signal under a specific sequential color condition of the dynamic filter.

13. The discharge lamp lighting apparatus according to claim 12, wherein the inverter controlling circuit has an inverter polarity resister which holds an inverter polarity signal which is a bit signal corresponding to a polarity state of the inverter, and an original inverter polarity signal generation circuit which generates an original inverter polarity signal set in the inverter polarity resister, and the original inverter polarity signal is set in the inverter polarity resister in synchronization with the modulation switching timing signal, and wherein after the original inverter polarity signal generation circuit receives the modulation switching timing signal, the original inverter polarity signal generation circuit updates the original inverter polarity signal so as to be a value set in the inverter polarity resister when the next modulation switching timing signal is inputted.

* * * * *